US005308748A

United States Patent [19]

Ikegawa et al.

[11] Patent Number: 5,308,748

[45] Date of Patent: May 3, 1994

[54] SILVER HALIDE PHOTOGRAPHIC LIGHT-SENSITIVE MATERIAL

[75] Inventors: Akihiko Ikegawa; Masayuki Kuramitu; Masaki Okazaki, all of Kanagawa, Japan

[73] Assignee: Fuji Photo Film Co., Ltd., Kanagawa, Japan

[21] Appl. No.: 35,697

[22] Filed: Mar. 23, 1993

[30] Foreign Application Priority Data

Mar. 23, 1992 [JP] Japan ..... 4-94872

[51] Int. Cl.[5] ..... G03C 1/12; G03C 1/29

[52] U.S. Cl. ..... 430/574; 430/576; 430/583; 430/584; 430/585

[58] Field of Search ..... 430/576, 574, 583, 584, 430/585

[56] References Cited

U.S. PATENT DOCUMENTS 3,282,933 11/1966 Nys et al. .

*Primary Examiner*—Thorl Chea

*Attorney, Agent, or Firm*—Sughrue, Mion, Zinn, Macpeak & Seas

[57] ABSTRACT

A silver halide photographic light-sensitive material comprising a support having thereon at least one light emulsion layer containing (A) at least one of the methine compounds represented by the following formula (I) and (B) at least one of the methine compounds represented by the following formula (II) or (III):

Formula (I)

Formula (II)

Formula (III)

wherein $Z^1$, $Z^2$, $R^1$, $R^2$, $L_1$-$L_8$, p, q, $k_1$-$k_3$, $n_1$-$n_3$ and $X_1$-$X_3$ are as defined in the specification.

5 Claims, No Drawings

SILVER HALIDE PHOTOGRAPHIC LIGHT-SENSITIVE MATERIAL

FIELD OF THE INVENTION

The present invention relates to a silver halide photographic light-sensitive, material which has improved residual color in development processing and sensitivity.

BACKGROUND OF THE INVENTION

Rapidity in development processing and addition of a lot of sensitizing dyes in recent years have been accompanied with a large problem in that the sensitizing dye present in a silver halide light-sensitive material is not completely eluted during processing and coloring (the so-called residual color) remains in the light-sensitive material.

Dyes having a hydrophilic substituent such as a sulfamoyl group or a carbamoyl group [for example, JP-A-1-147451 (the term "JP-A" as used herein means an unexamined published Japanese patent application), JP-A-61-294429, JP-B-45-32749 (the term "JP B" as used herein means an examined Japanese patent publication), and JP-A-61-77843) having less residual color have thus far been investigated as sensitizing dyes. However, the sensitivity is not sufficient in these cases since the increase in hydrophilicity of the sensitizing dye generally reduces adsorption. The residual color also is not reduced to a sufficiently satisfactory level. While residual color improvement effect can be achieved in the sensitizing dyes described in U.S. Pat. No. 3,282,933 and European Patent 451816A1, a sufficient effect is not obtained in terms of compatibility of residual color with sensitivity.

SUMMARY OF THE INVENTION

Accordingly, an object of the present invention is to provide a silver halide photographic light-sensitive material in which residual color in development processing is compatible with sensitivity.

The above object of the present invention has been achieved by a silver halide photographic light-sensitive material comprising a support having thereon at least one silver halide emulsion layer containing at least one of the methine compounds represented by the following Formula (I) and at least one of the methine compounds represented by the following Formula (II) or Formula (III):

Formula (I)

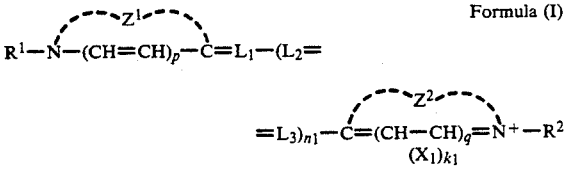

wherein $R^1$ represents $-(CH_2)_r-CONHS_2-R^3$, $-(CH_2)_s-SO_2NHCO-R^4$, $-(CH_2)_t-CONHCO-R^5$, or $-(CH_2)_u-SO_2NHSO_2-R^6$, in which $R^3$, $R^4$, $R^5$ and $R^6$ each represents an group, an alkoxy group or an amino group and r, s, t and u each represents an integer of 1 to 5; $R^2$ represents an alkyl group which is different from $R^1$; $Z^1$ and $Z^2$ may be the same or different and represent a group of non-metallic atoms necessary to form a 5- or 6-membered heterocyclic ring; $L_1$, $L_2$ and $L_3$ each represents a methine group; $n_1$ represents 0, 1 or 2; $X_1$ represents an anion; $k_1$ represents a number necessary to adjust the charge in the molecule to 0; and p and q each represents 0 or 1;

Formula (II)

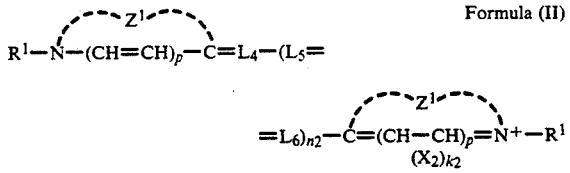

wherein $Z^1$ represents a group of the same non-metallic atoms as those defined for $Z^1$ in Formula (I); $R^1$ represents the same substituent as that defined for $R^1$ in Formula (I); $L_4$, $L_5$ and $L_6$ are the same as $L_1$, $L_2$ and $L_3$; $X_2$ is the same as $X_1$; $n_2$ is the same as $n_1$; and p represents the same number as that defined for p in Formula (I);

Formula (III)

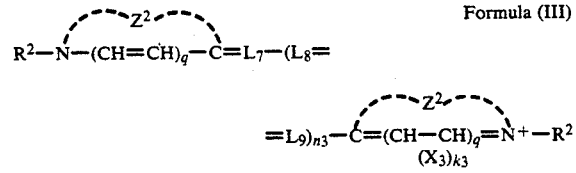

wherein $Z^2$ represents a group of the same non-metallic atoms as $Z^2$ in Formula (I); $R^2$ represents the same substituent as that defined for $R^2$ in Formula (I); $L_7$, $L_8$ and $L_9$ are the same as $L_1$, $L_2$ and $L_3$; $X_3$ is the same as $X_1$; $n_3$ is the same as $n_1$; and q represents the same number as that defined for q in Formula (I).

DETAILED DESCRIPTION OF THE INVENTION

The methine compound represented by Formula (I), Formula (II) or Formula (III) is explained below in greater detail.

The alkyl group represented by $R^3$, $R^4$, $R^5$ or $R^6$ may be substituted and is preferably a group having four or less carbon atoms. Particularly preferred is methyl, ethyl, methoxyethyl, hydroxyethyl, or amino-ethyl. The alkoxy group represented by $R^3$, $R^4$, $R^5$ or $R^6$ may be substituted and is preferably a group having four or less carbon atoms. Particularly preferred is methoxy, ethoxy, methoxyethoxy, or hydroxyethoxy. The amino group represented by $R^3$, $R^4$, $R^5$ or $R^6$ may be substituted with an alkyl group, a hydroxyalkyl group and an alkoxyalkyl group and the substituents themselves may combine to form a ring. The group having eight or less carbon atoms is preferred. Particularly preferred is methylamino, dimethylamino, ethylamino, diethylamino, hydroxyethyl-amino, morpholino, or pyrrolidino. A hydrogen atom bonded to a nitrogen atom adjacent to a carbonyl group or a sulfonyl group represented by $R^1$ is dissociative and therefore $R^1$ can have the form of $-(CH_2)_r-CON^-SO_2-R^3$, $-(CH_2)_s-SO_2N^-CO-R^4$, $-(CH_2)_t-CON^-CO-R^5$, or $-(CH_2)_u-SO_2N^-SO_2-R^6$ in the presence of base.

The alkyl group represented by $R^2$ is preferably a group having five or less carbon atoms and particularly preferred is methyl, ethyl, 2-sulfoethyl, 3-sulfopropyl, 4-sulfobutyl, or 3-sulfobutyl. Preferred as r, s, t or u is 1, 2 or 3.

Examples of the 5- or 6-membered heterocyclic nucleus formed by $Z^1$ and $Z^2$ include a thiazole nucleus such as a thiazole nucleus (for example, thiazole, 4-methylthiazole, 4-phenylthiazole, 4,5-dimethylthiazole, and 4,5-diphenylthiazole), a benzothiazole nucleus (for example, benzothiazole, 4-chlorobenzothiazole, 5-chlorobenzothiazole, 6-chlorobenzothiazole, 5-nitrobenzothiazole, 4-methylbenzothiazole, 5-methylbenzothiazole, 6 methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-carboxybenzothiazole, 5-phenethylbenzothiazole, 5-fluorobenzothiazole, 5-chloro-6-methylbenzothiazole, 5,6-dimethylbenzothiazole, 5,6-dimethoxybenzothiazole, 5-hydroxy-6-methylbenzothiazole, tetrahydrobenzothiazole, and 4-phenylbenzothiazole), and a naphthothiazole nucleus (for example, naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, and 5-methoxynaphtho[2,3-d]thiazole); a thiazoline nucleus (for example, thiazoline, 4-methylthiazoline and 4-nitrothiazoline); an oxazole nucleus such as an oxazole nucleus (for example, oxazole, 4-methyloxazole, 4-nitroxazole, 5-methyloxazole, 4-phenyloxazole, 4,5-diphenyloxazole, and 4-ethyloxazole), a benzoxazole nucleus (for example, benzoxazole, 5-chlorobenzoxazole, 5-methylbenzoxazole, 5-bromobenzoxazole, 5-phenylbenzooxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzooxazole, 6-nitrobenzooxazole, 6-methoxybenzoxazole, 6-hydroxybenzoxazole, 5,6-dimethylbenzoxazole, 4,6-dimethylbenzoxazole, and 5-ethoxybenzoxazole), and a naphthoxazole nucleus (for example, naphtho[2,1-d]oxazole, naphtho[1,2-d]oxazole, naphtho[2,3-d]oxazole, and 5-nitronaphtho[2,1-d]oxazole); an oxazoline nucleus (for example, 4,4-dimethyloxazoline); a selenazole nucleus such as a selenazole nucleus (for example, 4-methylselenazole, 4-nitroselenazole, and 4-phenylselenazole), a benzoselenazole nucleus (for example, benzoselenazole, 5-cholorobenzoselenazole, 5-nitrobenzoselenazole, 5-methoxybenzoselenazole, 5-hydroxybenzoselenazole, 6-nitrobenzoselenazole, 5-chloro-6-nitrobenzoselenazole, and 5,6-dimethylbenzoselenazole), and a naphthoselenazole nucleus (for example, naphtho[2,1-d]selenazole and naphtho[1,2-d]selenazole); a selenazoline nucleus (for example, selenazoline and 4-methylselenazoline); a tellurazole nucleus such as a tellurazole nucleus (for example, tellurazole, 4-methyltellurazole, and 4-phenyltellurazole), a benzotellurazole nucleus (for example, benzotellurazole, 5-chlorobenzotellurazole, 5-methylbenzotellurazole, 5,6-dimethylbenzotellurazole, and 6-methoxybenzotellurazole), and a naphthotellurazole nucleus (for example, naphtho[2,1-d]tellurazole and naphtho[1,2-d]tellurazole); a tellurmethyltellurazoline); a 3,3-dialkylindolenine nucleus (for example, 3,3-dimethylindolenine, 3,3-diethylindolenine, 3,3-dimethyl-5-cyanoindolenine, 3,3-dimethyl-6-nitroindolenine, 3,3-dimethyl-5-nitroindolenine, 3,3-dimethyl-5-methoxyindolenine, 3,3,5-trimethylindolenine, and 3,3-dimethyl-5-chloroindolenine): an imidazole nucleus such as an imidazole nucleus (for example, 1-alkylimidazole, 1 alkyl-4-phenylimidazole, and 1-arylimidazole), a benzimidazole nucleus (for example, 1-alkylbenzimidazole, 1-alkyl-5-chlorobenzimidazole, 1-alkyl-5,6-dichlorobenzimidazole, 1-alkyl-5-methoxybenzimidazole, 1-alkyl-5-cyanobenzimidazole, 1-alkyl-5-fluorobenzimidazole, 1-alkyl-5-trifluoromethylbenzimidazole, 1-alkyl-6-chloro-5-cyanobenzimidazole, 1-alkyl-6-chloro-5-trifluoromethylbenzimidazole, 1-allyl-5,6-dichlorobenzimidazole, 1-allyl-5-chlorobenzimidazole, 1-arylbenzimidazole, 1-aryl-5-chlorobenzimidazole, 1-aryl-5,6-dichlorobenzimidazole, 1-aryl 5-methoxybenzimidazole, and 1-aryl 5-cyanobenzimidazole), and a naphthoimidazole nucleus (for example, alkylnaphtho[1,2-d]imidazole and 1-arylnaphtho[1,2-d]imidazole), in which preferred as the above alkyl group is an alkyl group having 1 to 8 carbon atoms, for example, an unsubstituted alkyl group such as methyl, ethyl, propyl, isopropyl and butyl, and a hydroxyalkyl group (for example, 2-hydroxyethyl and 3-hydroxypropyl), and particularly preferred are methyl and ethyl, and the above aryl group represents phenyl, phenyl substituted with a halogen atom (for example, chlorine), phenyl substituted with an alkyl group (for example, methyl), and phenyl substituted with an alkoxy group (for example, methoxy); a pyridine nucleus (for example, 2-pyridine, 4-pyridine, 5-methyl-2-pyridine, and 3-methyl-4 pyridine); a quinoline nucleus such as a quinoline nucleus (for example, 2-quinoline, 3-methyl-2-quinoline, 5-ethyl-2-quinoline, 6-methyl-2-quinoline, 6-nitro-2-quinoline, 8 fluoro-2-quinoline, 6-methoxy-2-quinoline, 6-hydroxy-2-quinoline, 8-chloro-2 quinoline, 4-quinoline, 6-ethoxy-4-quinoline, 6-nitro-4-quinoline, 8-chloro-4-quinoline, 8-fluoro-4-quinoline, 8-methyl-4-quinoline, 8-methoxy-4-quinoline, 6-methyl-4-quinoline, 6-methoxy-4-quinoline, and 6-chloro-4-quinoline), and an isoquinoline nucleus (for example, 6-nitro-1-isoquinoline, 3,4-dihydro-1-isoquinoline, and 6-nitro-3-isoquinoline); an imidazo[4,5-b]quinoxaline nucleus (for example, 1,3 diethylimidazo[4,5-b]quinoxaline and 6-chloro 1,3-diallylimidazo[4,5-b]quinoxaline); an oxadazole nucleus; a thiadiazole nucleus; a tetrazole nucleus; and a pyrimidine nucleus.

Of these heterocyclic nuclei, a thiazole nucleus, a benzothiazole nucleus, a naphtho-thiazole nucleus, an oxazole nucleus, a benzoxazole nucleus, a naphthoxazole nucleus, a benzimidazole nucleus, a naphthoimidazole nucleus, and a quinoline nucleus are preferred. Most preferred are a benzothiazole nucleus, a benzoselenazole nucleus, or a quinoline nucleus.

The methine groups represented by $L_1$, $L_2$ and $L_3$ may be substituted and examples of substituents include an alkyl group which can be substituted (for example, methyl, ethyl and 2-carboxyethyl), an aryl group which can be substituted (for example, phenyl and o-carboxyphenyl), a halogen atom (for example, a chlorine atom and a bromine atom), an alkoxy group (for example, methoxy and ethoxy), and an alkylthio group (for example, methylthio and ethylthio). They may form a ring with the other methine groups or may form with an auxochrome. Examples of anions represented by $X_1$ include an inorganic or organic acid anion (for example, chloride, bromide, iodide, p-toluenesulfonate, naphthalenedisulfonate, methanesulfonate, methylsulfonate, ethylsulfonate, and perchlorate).

$n_1$ preferably is 0 or 1.

The methine compounds represented by Formula (I), Formula (II) or Formula (III) can be synthesized according to the methods described in *Heterocyclic Compounds-Cyanine Dyes and Related Compounds,* F. M. Harmer, John Wiley & Sons Co., Ltd. (New york, London) 1964; *Heterocyclic Compounds-Special Topics in Heterocyclic Chemistry,* D. M. Sturmer, Chapter 18, Section 14, pp. 482 to 515, John Wiley & Sons Co., Ltd. (New York, London) 1977; and *Rodd's Chemistry of Carbon Compounds,* (2nd Ed. vol. IV, part B, edited in 1977), Chapter 15, pp. 369 to 422, and (2nd Ed. vol. IV, part B, edited in 1985), Chapter 15, pp. 267 to 296, Elsvier Science Publishing Company Inc., New York.

Representative examples of methine compounds represented by Formula (I), Formula (II) or Formula (III) are shown below but the scope of the present invention is not limited only to these compounds.

I-1

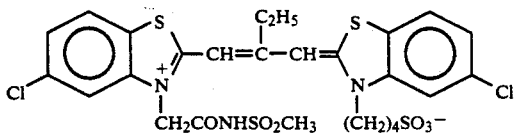

I-2

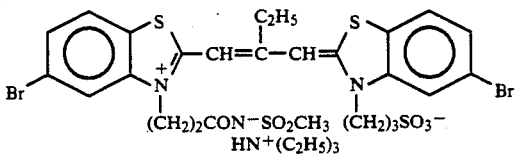

I-3

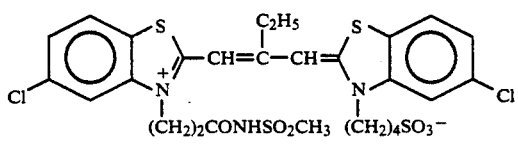

I-4

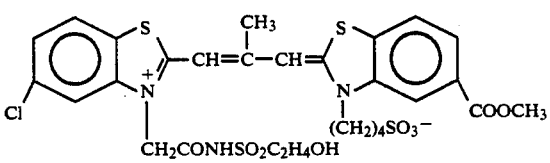

I-5

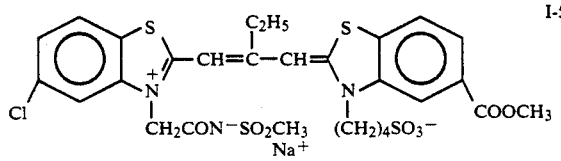

I-6

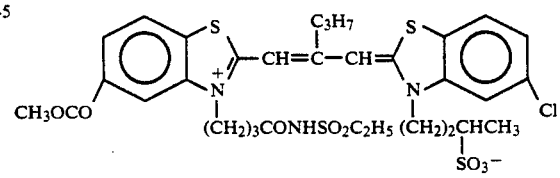

I-7

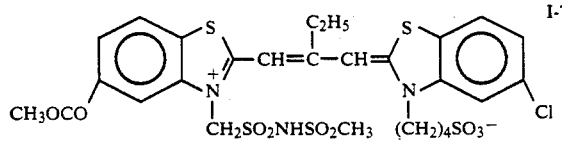

I-8

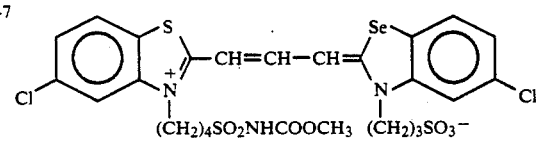

I-9

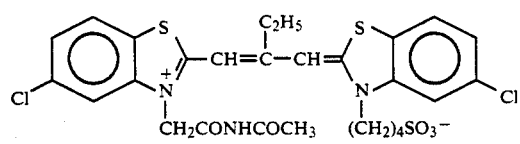

I-10

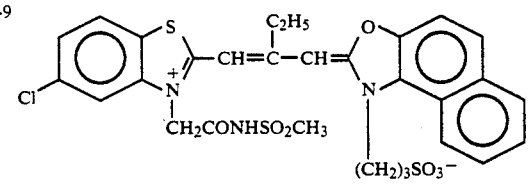

I-11

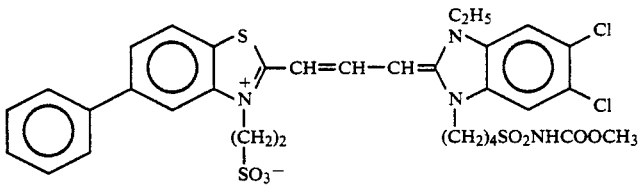

I-12

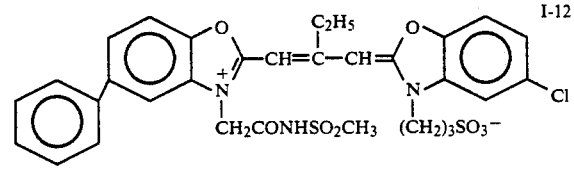

I-13

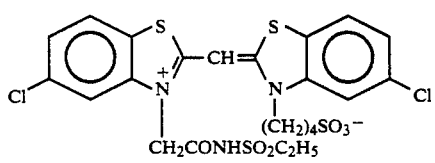

I-14

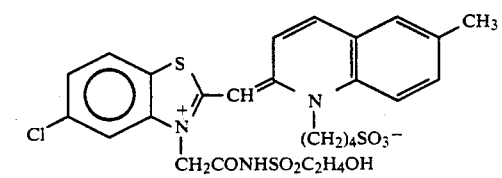

I-15

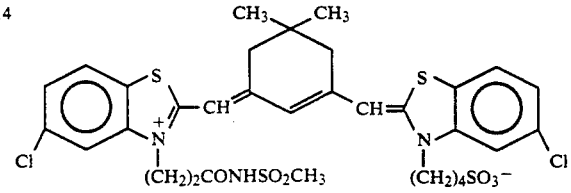

-continued
I-16
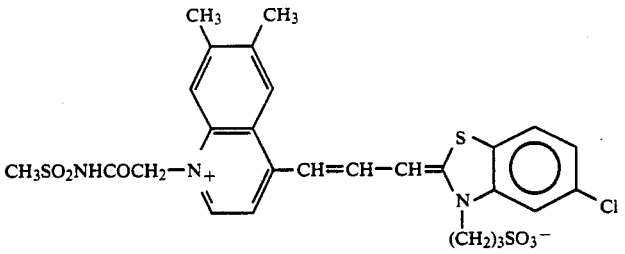
I-17
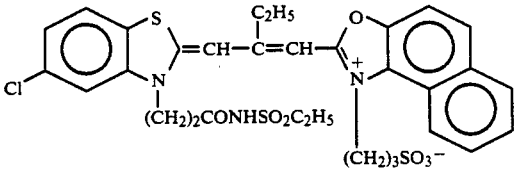
I-18
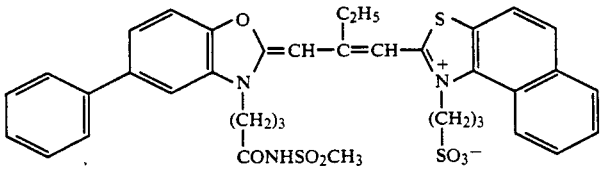
I-19
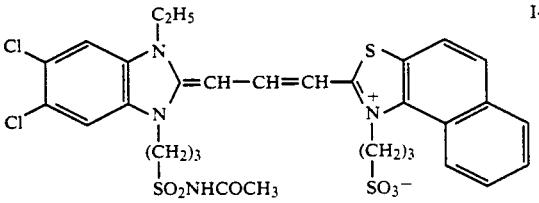
I-20
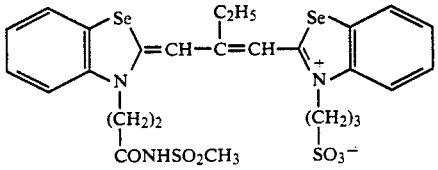
I-21
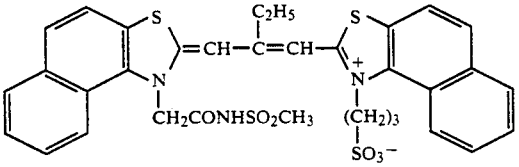
I-22
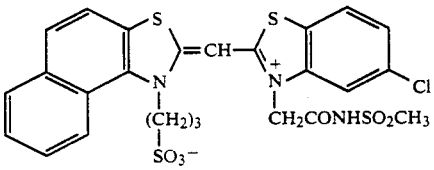
I-23
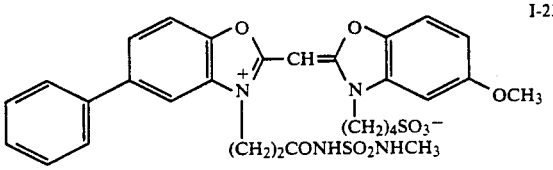
I-24
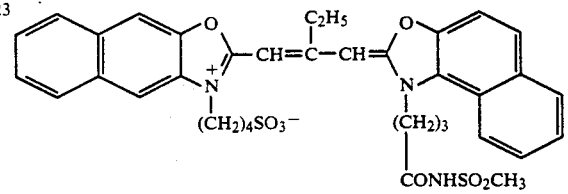
I-25
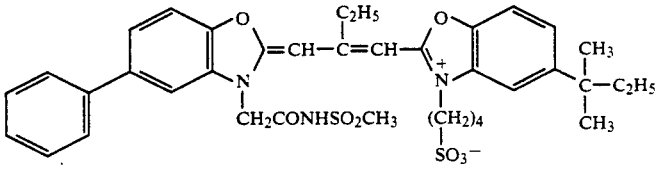

-continued
I-26
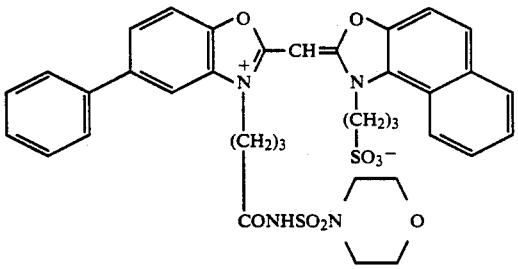
I-27
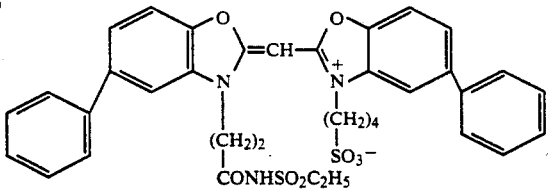
I-28
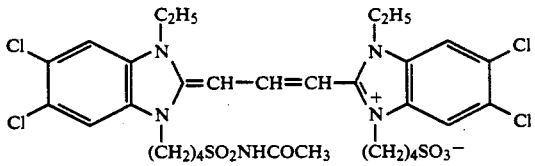
I-29
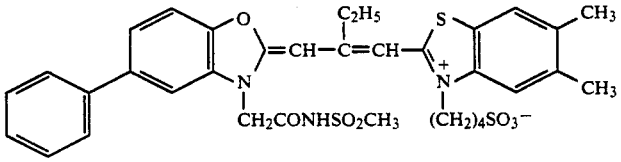
I-30
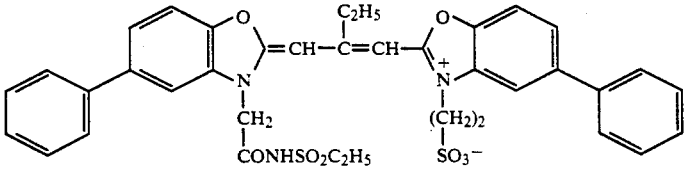
I-31
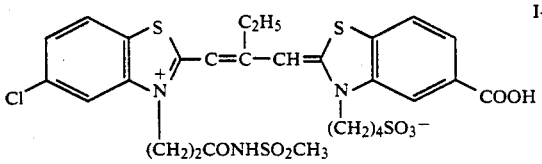
I-32
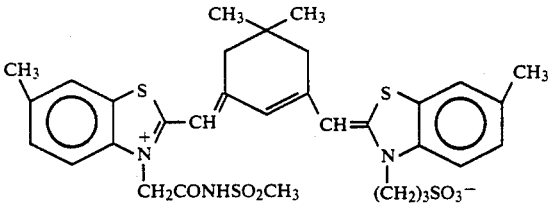
II-1
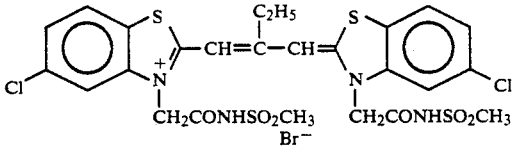
II-2
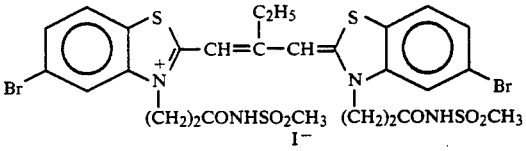
II-3
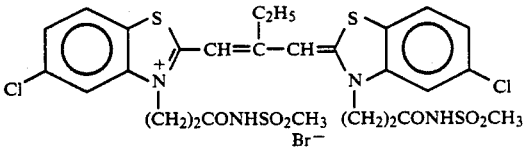
II-4
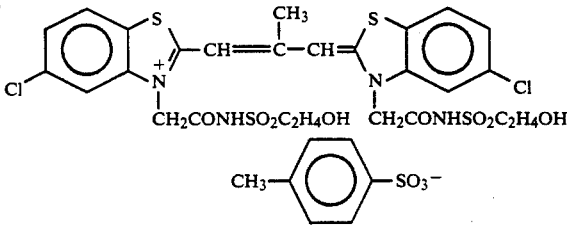
II-5
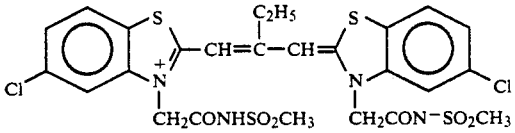

-continued
II-6
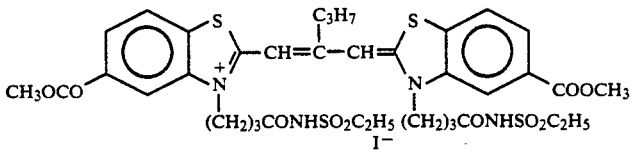
II-7
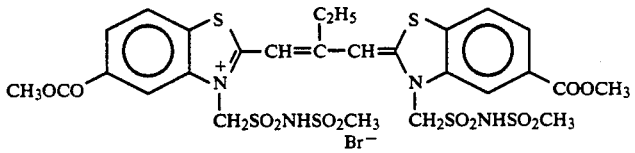
II-8
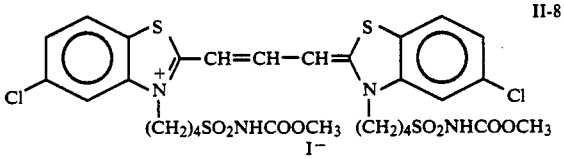
II-9
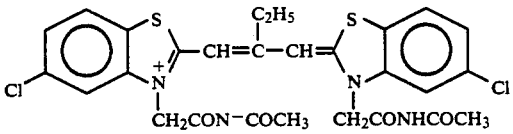
II-10
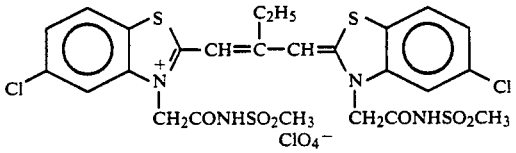
II-11
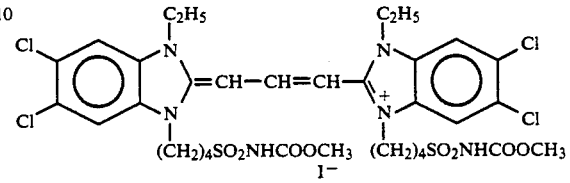
II-12
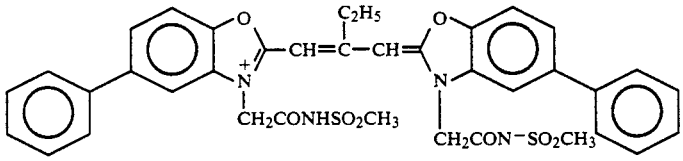
II-13
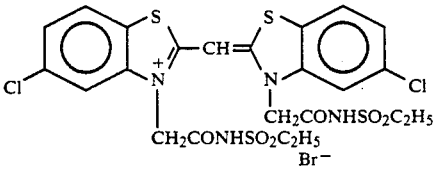
II-14
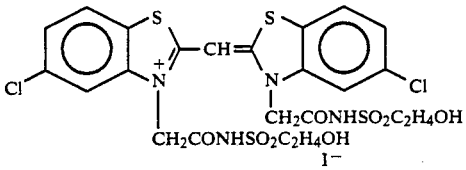
II-15
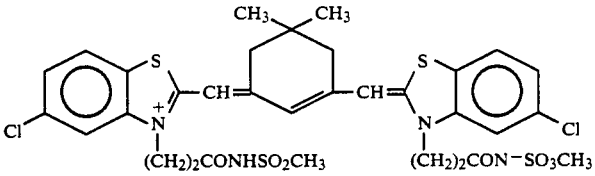
II-16
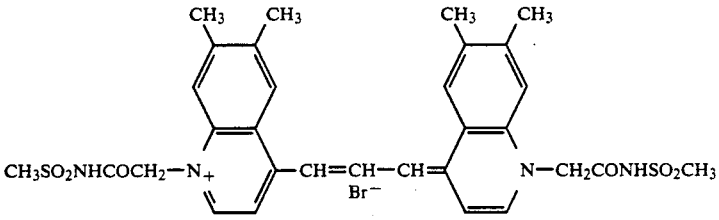
II-17
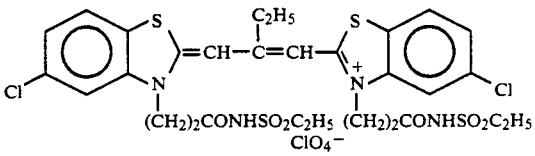

-continued
II-18
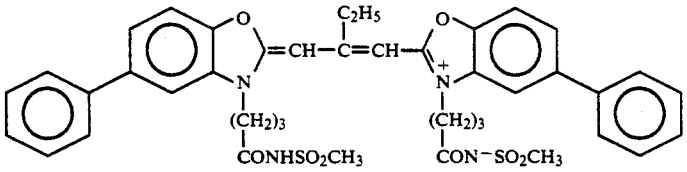
II-19
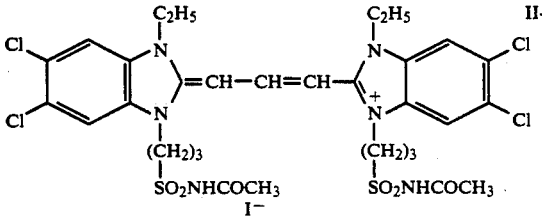
II-20
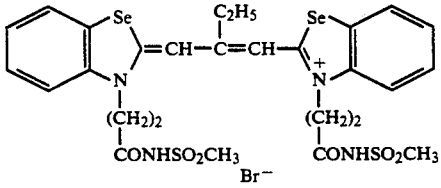
II-21
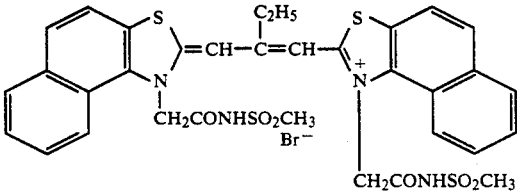
II-22
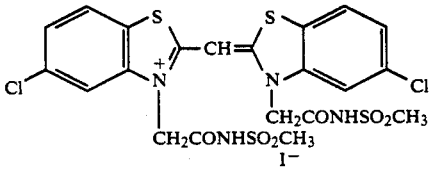
II-23
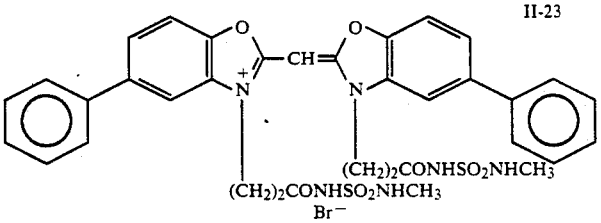
II-24
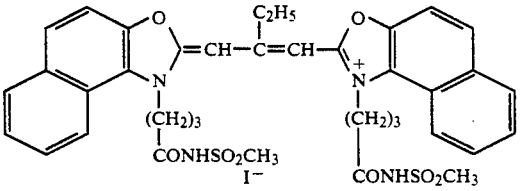
II-25
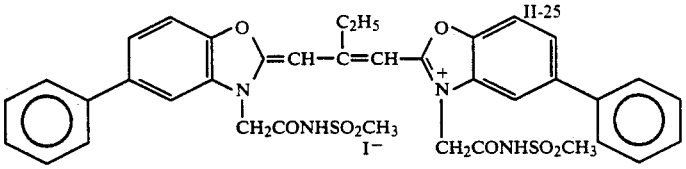
II-26
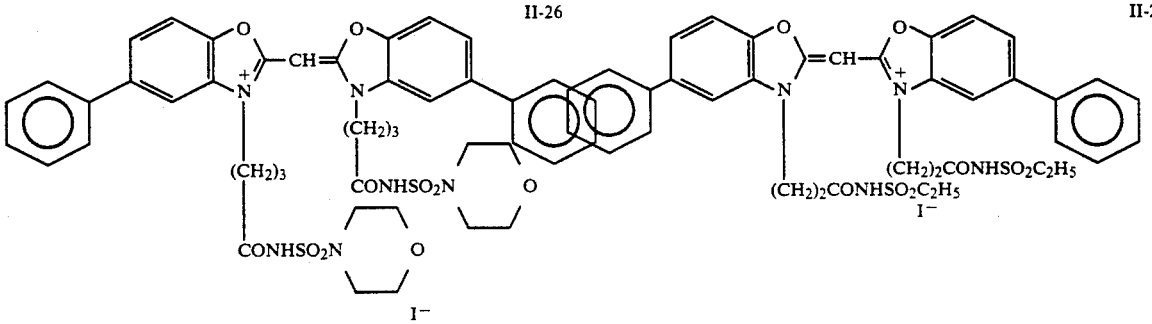
II-27

-continued
II-28
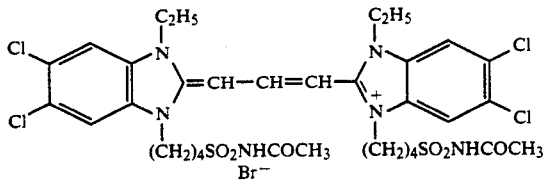
II-29
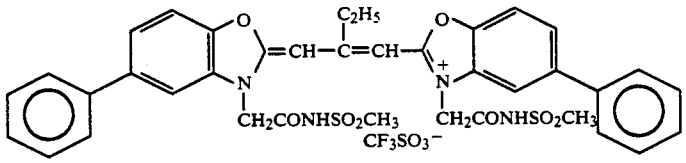
II-30
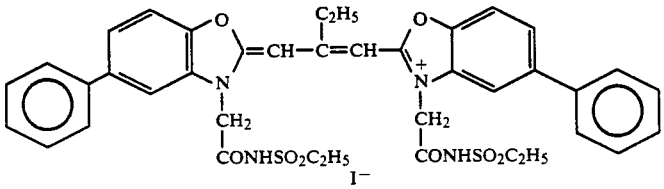
II-31
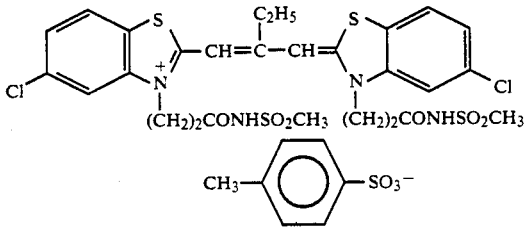
II-32
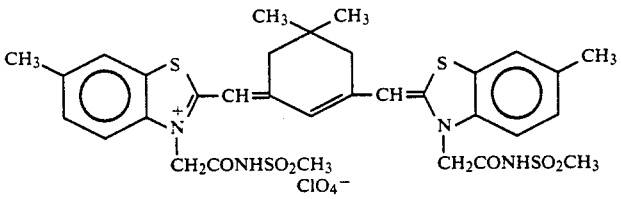
III-1
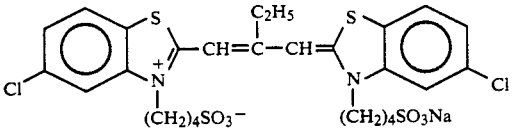
III-2
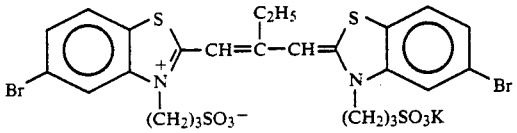
III-3
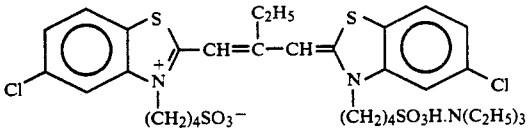
III-4
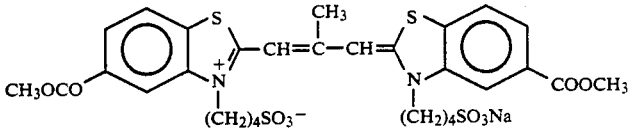
III-5
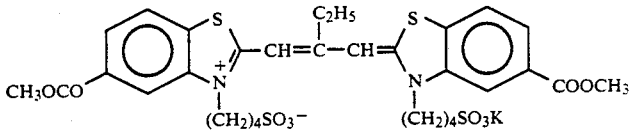

-continued
III-6
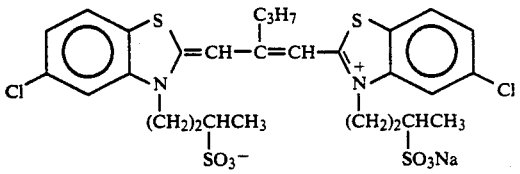
III-7
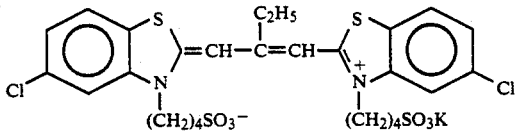
III-8
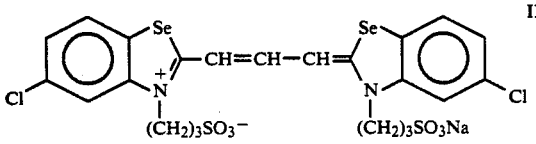
III-9
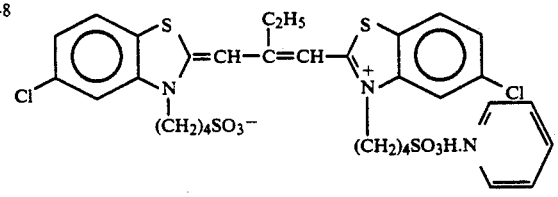
III-10
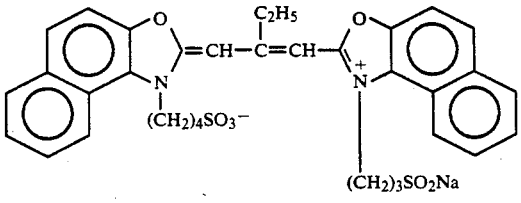
III-11
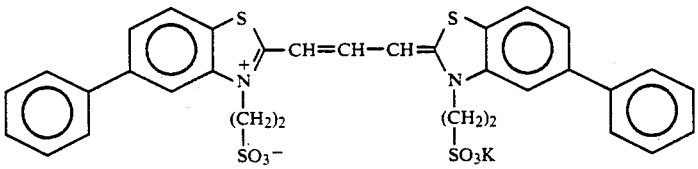
III-12
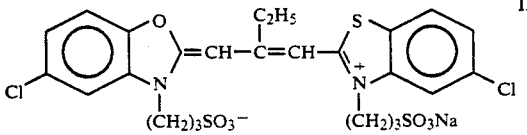
III-13
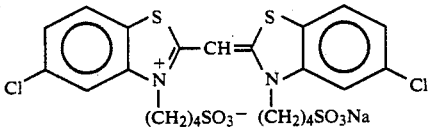
III-14
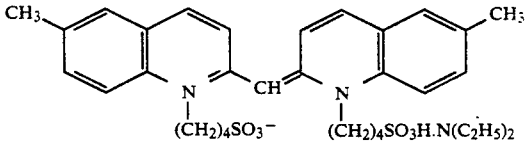
III-15
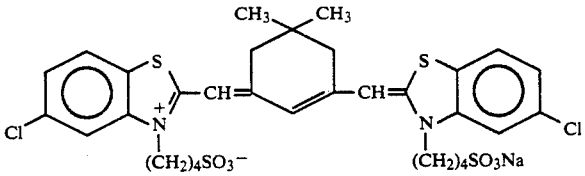
III-16
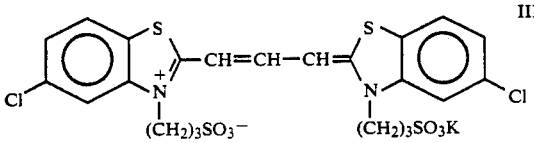
III-17
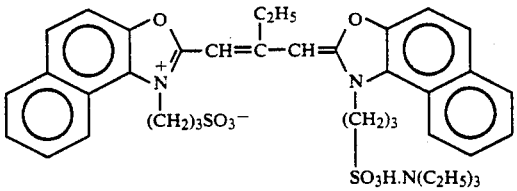

-continued
III-18
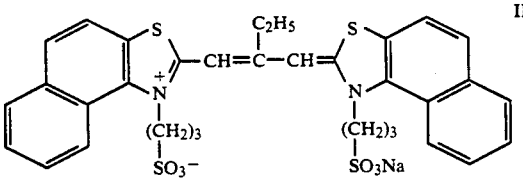
III-19
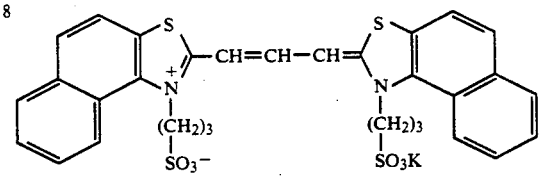
III-20
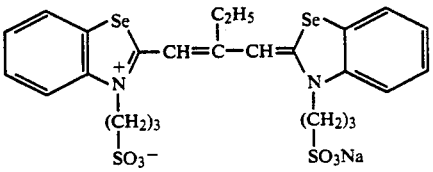
III-21
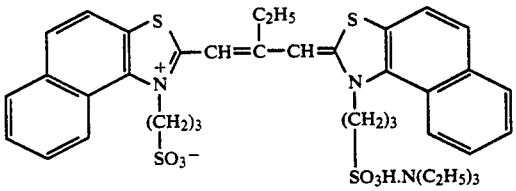
III-22
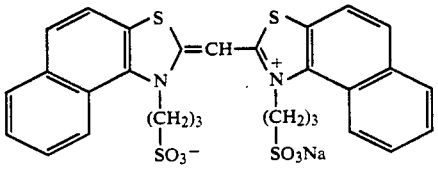
III-23
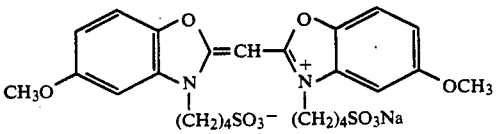
III-24
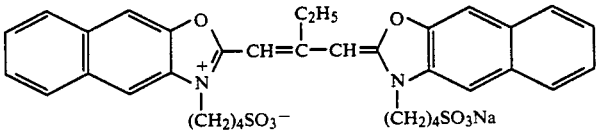
III-25
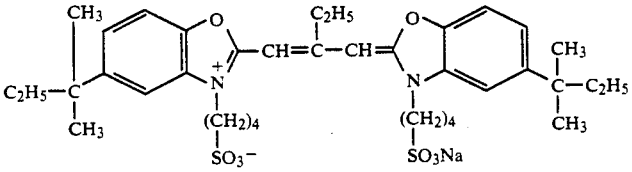
III-26
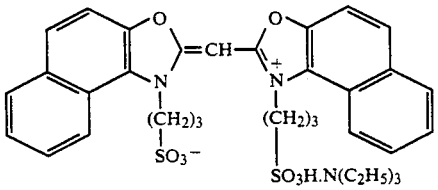
III-27
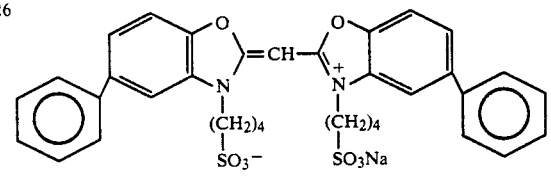
III-28
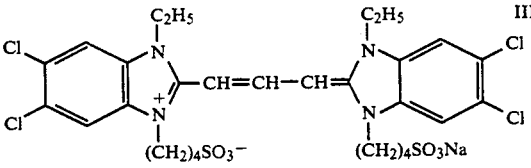
III-29
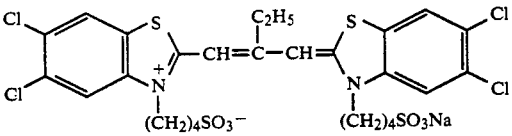
III-30
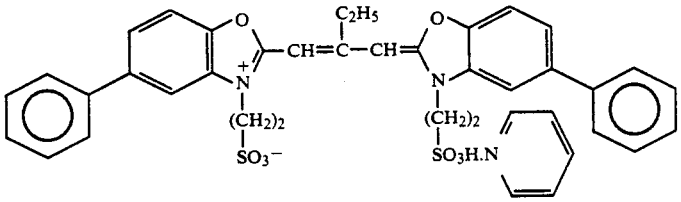
III-31
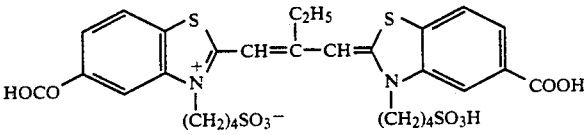

-continued

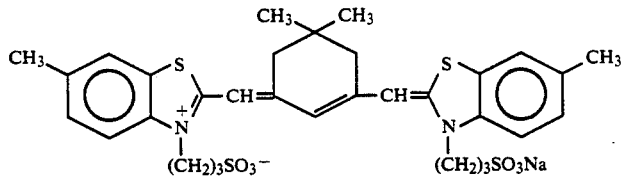

III-32

The photographic emulsions which can be used in the present invention may be spectrally sensitized with a methine dye and other dyes in addition to the methine compounds represented by the Formula (I), (II) or (III), so long as the effects of the present invention can be achieved. The addition amount of the methine dye and other dyes is $10^{-3}$ to $10^{3}$ mole per mole of the methine compounds represented by the Formula (I), (II) or (III). Suitable dyes include a cyanine dye, a merocyanine dye, a composite cyanine dye, a composite merocyanine dye, a holopolarcyanine dyes include a hemicyanine dye, a styryl dye, and a hemioxonol dye. Particularly useful dyes are a cyanine dye, a merocyanine dye, and a dye belonging to a composite merocyanine dye. Any of the nuclei cyanine dyes usually have can be present in these dyes as basic heterocyclic ring nuclei. A pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, and a pyridine nucleus; the nuclei formed by condensing these nuclei with alicyclic hydrocarbon rings; and nuclei formed by condensing these nuclei with aromatic hydrocarbon rings, that is, an indolenine nucleus, a benzindolenine nucleus, an indole ring, a benzoxazole nucleus, a naphthoxazole nucleus, a benzothiazole nucleus, a naphtothiazole nucleus, a benzoselenazole nucleus, a benzimidazole nucleus, and a quinoline nucleus can be employed. These nuclei may contain substituents on the carbon atoms.

A 5 to 6-membered heterocyclic ring nucleus such as a pyrazoline-5-one nucleus, a thiohydantoin nucleus, a 2-thioxazolidine-2,4-dione nucleus, a thiazolidine-2,4-dione nucleus, a rhodanine nucleus, and a thiobarbituric acid nucleus can be employed in the merocyanine dyes or composite merocyanine dyes as a nucleus having a ketomethylene structure.

The compounds of the present invention may be used either alone or as combinations thereof. In particular, a combination of the sensitizing dyes is often used for the purpose of supersensitization. Representative examples thereof are described in U.S Pat. Nos. 2,688,545, 2,977,229, 3,397,060, 3,522,052, 3,527,641, 3,617,293, 3,628,964, 3,666,480, 3,672,898, 3,679,428, 3,03,377, 3,769,301, 3,814,609, 3,837,862, and 4,026,707, British Patents 1,344,281 and 1,507,804, JP-B-43-49336 and JP-B-53-12375, and JP-A-52-110618 and JP-A-52-19925.

Compounds which are dyes providing no spectral sensitization by themselves or materials absorbing substantially no visible light and which provide supersensitization may be present in an emulsion in addition to the compounds used in the present invention.

The timing of adding the compounds used in the present invention to an emulsion may be at any step of preparing the emulsion, thus so far known as effective. Most usually, it is added after completion of the chemical sensitization but before coating. However, as described in U.S. Pat. Nos. 3,628,969 and 4,225,666, the compounds can be added at the same time as the chemical sensitization to simultaneously carry out spectral sensitization and chemical sensitization. Also, as described in JP-A-58-113928, spectral sensitization can be carried out prior to chemical sensitization. Also, the compounds can be added before completion of formation of silver halide grain precipitation to thereby commence spectral sensitization. Further, as disclosed in U.S. Pat. No. 4,225,666, the above-mentioned compounds can be added portionwise; that is, a part thereof is added prior to chemical sensitization and the remainder is added after chemical sensitization. The addition of the compounds may be during the formation of the silver halide grains as well as the method taught in U.S. Pat. No. 4,183,756.

The addition amount thereof which can be used is $4\times10^{-6}$ to $8\times10^{-3}$ mole per mole of silver halide and more preferably $5\times10^{31\ 5}$ to $2\times10^{-3}$ mole per mole of silver halide in case of a more preferable silver halide grain size of 0.2 to 1.2 μm.

The compound represented by Formula (II) or Formula (III) is used preferably in a range of 0.01 to 30 wt%, most preferably 0.1 to 10 wt% based on the compound represented by Formula (I).

The silver halide emulsion used in the present invention may have any grain size distribution and the grains having a grain size which falls within a grain size range of the peak grain size (average) ±20% occupy preferably 60% or more, more preferably 80% or more, of the total silver halide grain weight.

The grain size of silver halide may be either a fine grain of 0.1 micron or less or a large size grain having a projected area-circle corresponding diameter of up to 10 micron.

Silver halide present in the light-sensitive material used in the present invention is silver bromoiodide, silver chloroiodide or silver bromochloroiodide each containing 0.1 to 30 mole% of silver iodide. Particularly preferred is silver bromoiodide or silver bromochloroiodide each containing up to about 2 to about 25 mole% of silver iodide.

The silver halide grains present in the photographic emulsion may have a regular crystal shape such as a cube, octahedron and tetradecahedron, an irregular crystal form such as a sphere and a plate, a defective crystal form such as a twinned crystal, or a composite form thereof.

The silver halide emulsion may be either a polydisperse emulsion or a monodisperse emulsion.

The silver halide photographic emulsion capable of being used in the present invention can be prepared by the methods described in, for example, *Research Disclosure* (RD) No. 17643 (December 1978), pp. 22 to 23, "I. Emulsion Preparation and Types", ibid., No. 18716 (November 1979), p. 648, and ibid., No. 307105 (November 1989), pp. 863 to 865, *Chimie et Physique Photographique*, P. Glafkides, Paul Montel Co. (1967), *Photographic Emulsion Chemistry*, G. F. Duffin, Focal Press Co. (1966), and *Making and Coating Photographic Emulsin,* V. L. Zelikman et al, Focal Press Co. (1964).

Also preferred are the monodisperse emulsions described in U.S. Pat. Nos. 3,574,628 and 3,655,394, and British Patent 1,413,748.

The emulsion containing 50% (area) or more of AgX grains having an aspect ratio (projected area circle corresponding diameter of the AgX grains/grain thickness) of about 3 or more based o the total AgX grains present in the emulsion can also be used in the present invention. The tabular grains can readily be prepared by the methods described in *Photographic Science and Engineering,* Gutoff, vol. 14, pp. 248 to 257 (1970), U.S. Pat. Nos. 4,434,226, 4,414,310, 4,433,048, and 4,439,520, and British Patent 2,112,157.

A nucleus in a silver halide emulsion comprising a regular grain is formed and a grain is grown by a double jet method while keeping the pAg constant and maintaining a saturation degree to such extent that new nuclei are not generated, whereby the grains with a desired grain size can be obtained.

Further, the method described in JP-A-54-48521 can be employed. In a preferred embodiment of the above method, a silver halide emulsion is produced by the method in which a potassium iodide gelatin aqueous solution and an ammoniacal silver nitrate aqueous solution are added to a gelatin aqueous solution containing silver halide grains while varying the addition speed as a function to time. In this method, the time function in the addition speed, pH, pAg, and the temperature are appropriately selected, whereby a highly monodisperse silver halide emulsion can be obtained. The details thereof are described in, for example, *Photographic Science and Engineering,* vol. 6, pp. 159 to 165 (1962), *Journal of Photographic Science,* vol. 12, pp. 242 to 251 (1964), U.S. Pat. No. 3,655,394, and British Patent 1,413,748.

The crystal structure may be either of a uniform constitution or of a constitution in which the composition at an inner part is different from that at an outer part and it may also have a stratum constitution. These emulsion grains are disclosed in British Patents 1,027,146, 3,505,068, and 4,444,877, and JP-A-58-248649. Further, silver halides each having a different composition may be joined by epitaxial junction and compounds other than silver halide, such as silver rhodanide and lead oxide, may be joined thereto.

The silver halide emulsion according to the present invention has preferably a distribution or structure in the inside of the grain with respect to halogen composition. A typical example thereof is a core - shell type or double layer structure grain having different compositions in the inside and at the surface of the grain, as disclosed in JP-B-43-13162,, and JP A-61-215540, JP-A-60-222845, and JP-A-61-75337.

Further, it is possible to have a triple layer or multiple layer structure, in addition to a double layer structure, as disclosed in JP-A-60-222844 and to deposit a thin silver halide layer having a different composition on the surface of a core - shell grain of a double layer structure.

The non-uniform structure can be provide in an inside of a grain not only by the above methods for forming wrapping-in structure but also by methods for forming a so-called junction structure. These examples are disclosed in JP-A-59-133540 and JP-A 58-108526, EP 199290A2, JP-B-58-24772, and JP-A-59-16254. A crystal to be joined has a composition different from that of a crystal which is the host and is joined at an edge or a corner portion or on a plane of the host crystal, whereby a junction structure can be formed. Such a junction crystal can be formed with a host crystal having either a uniform silver halide composition or a core-shell type structure.

In case of a junction structure, the combination of silver halides themselves is naturally possible and it also is possible to have a junction structure in which a silver salt compound having a structure other than rock salt structure, such as silver rhodanide and silver carbonate, is combined with silver halide. Further, a non-silver salt compound such as PbO may be present if the junction structure is possible.

In case of the silver bromoiodide grains having these structures, for example, the core-shell type grain may be either a grain in which a core portion has a high silver iodide content and a shell portion has a low silver iodide content or a grain in which on the contrary the core portion has a low silver iodide content and the shell portion has a high silver iodide content. Similarly, a grain having a junction structure also may be either a grain in which a host crystal has a high silver iodide content and a joined crystal has a relatively low silver iodide content or a grain in which on the contrary the host crystal has a low silver iodide content and the joined crystal has a relatively high silver iodide content.

Further, the boundary portion at the different compositions in the grains having these structures may be either a clear boundary or a diffuse boundary at which a mixed crystal is formed by a composition difference, or a boundary at which a continuous structural difference positively occurs.

The silver halide emulsion used in the present invention may be subjected to a treatment with which a roundness is given to a grain as disclosed in EP-0096727B1 and EP-0064412B1, or to a surface reformation as disclosed in DE-2306447C2 and JP-A-60 221320.

The silver halide emulsion used in the present invention is preferably a surface latent image type emulsion. However, a developing solution or a developing condition can be selected to use as well an internal latent image type emulsion as disclosed in JP-A-59-133542. Further, a shallow internal latent image type emulsion in which a thin shell is provided as described in JP-A-63-264740 can be advantageously used.

A silver halide solvent is useful for accelerating ripening. It is known, for example, to permit an excess of halogen ion to be present in a reaction vessel in order to accelerate ripening. Accordingly, it is apparent that the mere introduction of a halide solution into the reaction vessel can achieve an acceleration of the ripening. Other ripening agents can be used as well. The entire amount of these ripening agents can be incorporated into a dispersant in the reaction vessel before adding a silver salt and a halide. Further, it is possible as well to introduce them into the reaction vessel at the same time as adding one or more of the halides, a silver salt or a peptitizer. The ripening agents can independently be introduced as another modified embodiment at the addition of the halides and the silver salt.

Ammonia or an amine compound, thiocyanates, for example, alkali metal thiocyanate, particularly sodium and potassium thiocyanates, and ammonium thiocyanate can be used as the ripening agent other than halogen ions.

It is very important in the present invention to provide chemical sensitization represented by sulfur sensitization and gold sensitization. The photographic property of a grain doped with a polyvalent metal ion of at least $1\times10^{-4}$ mole/mole of Ag has no characteristic in a primitive state and demonstrates a notable effect when it is chemically sensitized. A portion of an emulsion grain at which the chemical sensitization is provided is different according to a composition, structure and form of an emulsion grain and a use of the emulsion. Chemical sensitization nuclei can be provided in the inside of the grain, they can be provided at a portion which is close to the grain surface and they can be formed on the surface. The effects of the present invention are achieved in any cases but particularly preferred is the case that the chemical sensitization nucleus is formed in the vicinity of the surface. That is, the effects of the present invention are better achieved with a surface latent image type emulsion rather than with an internal latent image type emulsion.

The chemical sensitization can be carried out with active gelatin as described in *The Theory of the Photographic Process,* T. H. James, 4th Ed., MacMillan Co., pp. 67 to 76, (1977). Further, as described in *Research Disclosure* vol. 120, (April 1974), No. 12008, *Research Disclosure* vol. 34, (June 1975), No. 13452, U.S. Pat. Nos. 2,642,361, 3,297,446, 3,772,031, 3,857,711, 3,901,714, 4,266,018, and 3,904,415, and British Patent 1,315,755, chemical sensitization can be carried out with sulfur, selenium, tellurium, gold, platinum, palladium, iridium, or a combination of a plurality of these sensitizers at a pAg of 5 to 10, a pH of 5 to 8 and a temperature of 30° to 80° C. The chemical sensitization is optimumly carried out in the presence of a gold compound and a thiocyanate compound and in the presence of the sulfur-containing compounds described in U.S. Pat. Nos. 3,857,711, 4,266,018 and 4,054,457 or hypo, and sulfur-containing compounds such as thiourea compounds and rhodanide compounds. Chemical sensitization can be carried out as well in the presence of a chemical sensitization aid. Chemical sensitization aids include compounds which are known for controlling fog and increasing sensitivity during chemical sensitization, such as azaindenes, azapyridines and azapyrimidines. Examples of a chemical sensitization aid improver are described in U.S. Pat. Nos. 2,131,038, 3,411,914, and 3,554,757, JP-A 58-126526, and *Photographic Emulsion Chemistry,* Duffin, pp. 138 to 143.

The photographic emulsions used in the present invention can contain various compounds for the purposes of preventing fog during preparation, storage and photographic processing of the light-sensitive material and stabilizing the photographic properties. Many compounds which are known as an anti-foggant and a stabilizer, such as azoles, for example, a benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (in particular, 1-phenyl-5-mercaptoterazole); mercaptopyrimidines; mercaptotriazines; a thioketo compound, for example, such as oxazolinethion; azaindenes, for example, triazaindenes, tetrazaindenes [in particular, 4-hydroxy substituted (1,3,3a,7)tetrazaindenes], and pentazaindenes can be used. The compounds described in, for example, U.S. Pat. Nos. 3,954,474 and 3,982,947, and JP-B-52-28660 can be used.

The above various additives can be used for the light-sensitive material according to the present invention and in addition thereto, various additives can be used depending on the objects.

The details of these additives are described in *Research Disclosures* Item 17643 (December 1978) and ibid., Item 18716 (November 1979) and the corresponding portions thereof are summarized and shown in the following table.

| Kind of Additives | RD 17643 | RD 18716 |
|---|---|---|
| 1. Chemical Sensitizer | — | p. 648, right column |
| 2. Sensitivity Improver | — | p. 648, right column |
| 3. Spectral Sensitizer, Supersensitizer | pp. 23 to 24 | p. 648, right column to p. 649, right column |
| 4. Whitening Agent | p. 24 | — |
| 5. Anti-Foggant & Stabilizer | pp. 24 to 25 | p. 649, right column |
| 6. Light Absorber, Filter Dye, & UV Absorber | pp. 25 to 26 | p. 649, right column to p. 650, left column |
| 7. Anti-Stain Agent | p. 25, right column | p. 650, left column to right column |
| 8. Dye Image Stabilizer | p. 25 | — |
| 9. Hardener | p. 26 | p. 651, left column |
| 10. Binder | p. 26 | p. 651, left column |
| 11. Plasticizer & Lubricant | p. 27 | p. 650, right column |
| 12. Coating Aid & Surfactant | pp. 26 to 27 | p. 650, right column |
| 13. Anti-Static Agent | p. 27 | p. 650, right column |

Various color couplers can be used for the present invention and specific examples thereof are described in the patents abstracted in *Research Disclosure* (RD) No. 17643, VII-C to G.

Preferred as a yellow coupler are the compounds described in, for example, U.S. Pat. Nos. 3,933,501, 4,022,620, 4,326,024, and 4,401,752, JP-B-58-10739, and British Patents 1,425,020 and 1,476,760.

The 5-pyrazolone series and pyrazoloazole series compounds are preferred as magenta couplers. Particularly preferred are the compounds described in U.S. Pat. Nos. 4,310,619 and 4,351,897, European Patent 73,636, U.S. Pat. Nos. 3,061,432 and 3,725,067, *Research Disclosure* No. 24220 (June 1984), JP-A-60-33552, *Research Disclosure* No. 24230 (June 1984), JP-A-60-43659, and U.S. Pat. Nos. 4,500,630 and 4,540,654.

Examples of cyan coupler include phenol series and naphthol series couplers. Preferred are the compounds described in, for example, U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, German Patent Publication 3,329,729, European Patent 121,365A, U.S. Pat. Nos. 3,446,622, 4,333,999, 4,451,559, and 4,427,767, and European Patent 161,626A.

Preferred as colored couplers used for correcting unnecessary absorption of a color developed dye are the compounds described in *Research Disclosure* No. 17643, Item VII-G, U.S. Pat. No. 4,163,670, JP-B-57-39413, U.S. Pat. Nos. 4,004,929 and 4,138,258, and British Patent 1,146,368.

Preferred as couplers capable of forming a developed dye having an appropriate dispersing property are the compounds described in U.S. Pat. No. 4,366,237, British Patent 2,125,570, European Patent 96,570, and German Patent Publication 3,234,533.

Typical examples of dye-forming polymerized couplers are described in U.S. Pat. Nos. 3,451,820, 4,080,211, and 4,367,282, and British Patent 2,102,173.

A coupler releasing a photographically useful residue upon coupling can be advantageously used as well in the present invention. Preferred as a development inhibitor-releasing DIR couplers are the compounds described in the patents abstracted in *Research Disclosure,* No. 17643, VII-F, JP-A-57-151944, JP-A 57-154234 and JP-A-60-184248, and U.S. Pat. No. 4,248,962.

Preferred as couplers releasing imagewise a nucleus-forming agent or a development accelerator on development are the couplers described in British Patents 2,097,140 and 2,131,188, and JP-A-59-157638 and JP-A-59-170840.

In addition to the above compounds, the competitive couplers described in U.S. Pat. No. 4,130,427; the polyequivalent couplers described in U.S. Pat. Nos. 4,283,472, 4,338,393 and 4,310,618; the DIR redox compound or DIR coupler-releasing couplers or the DIR coupler-releasing couplers or redoxes described in JP-A-60-185950 and JP-A-62-24252; and the couplers releasing a dye whose color is recovered after releasing, described in European Patent 173,302A, and the bleaching accelerator-releasing couplers described in RD No. 11449 and No. 24241, and JP-A-61-201247; and the ligand-releasing compounds described in U.S. Pat. No. 4,553,477 are couplers capable of being used for the light-sensitive material according to the present invention.

The couplers used in the present invention can be introduced into the light-sensitive material using various conventional dispersing methods.

Examples of high boiling-solvents which can be used in an oil-in water dispersion method are described in U.S. Pat. No. 2,322,027. Specific examples of high boiling organic solvents which have a boiling point of 175° C. or higher at a normal pressure and are used in the oil-in-water dispersion method are phthalic acid esters (for example, dibutyl phthalate, dicyclohexyl phthalate, di-2-ethylhexyl phthalate, decyl phthalate, bis(2,4-di-t-amylphenyl)phthalate, bis(2,4-di-t-amylphenyl)isophthalate, and bis(1,1-diethylpropyl)phthalate), phosphoric acid or sulfonic acid esters (for example, triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, and di-2-ethylhexylphenyl phosphate), benzoic acid esters (for example, 2-ethylhexyl benzoate, dodecyl benzoate, and 2-ethylhexyl p-hydroxybenzoate), amides (for example, N,N-diethyldodecanamide, N,N-diethyllaurylamide, and N-tetradecylpyrrolidone), alcohols and phenols (for example, isostearyl alcohol and 2,4-di tert-amylphenol), ethylhexyl) sebacate, dioctyl azelate, glycerol tributylate, isostearyl lactate, and trioctyl citrate), aniline derivatives (for example, N,N-dibutyl-2-butoxy-5-tert-octylaniline), and hydrocarbons (for example, paraffin, dodecylbenzene, and diisopropylnaphthalene). Further, organic solvents having a boiling point of about 30° C. or higher, preferably 50° C. or higher and about 160° C. or lower can be used as an auxiliary solvent. Typical examples thereof are ethyl acetate, butyl acetate, ethyl propionate, methyl ethyl ketone, cyclohexanone, 2-ethoxyethyl acetate, and dimethylformamide.

Specific examples of the steps and effects in a latex dispersing method and latexes for impregnation are described in U.S. Pat. No. 4,199,363, and German Patent Applications (OLS) 2,541,274 and 2,541,23.

The present invention can be applied to various light-sensitive materials. A color negative film for a general use or movie use, a color reversal film for slides or television, a color paper, a color positive film, and a color reversal paper are representative examples thereof. The use thereof in black-and-white photographic light-sensitive materials, X ray light-sensitive materials and light sensitive materials for printing can provide a preferable effect as well.

Where the present invention is applied to a color photographing material, it can be applied to light-sensitive materials having various constitutions and light-sensitive materials in which the layer structure and specific color materials are combined.

Representative examples will be given below. For example, light-sensitive materials in which the coupling speed of a color coupler and the dispersibility are combined with a construction of the layers, as described in JP-B-47-49031, JP-B-49-3843, and JP-B-50-21248, and JP-A-59-58147, JP-A-59-60437, JP-A-60-227256, JP-A-61-4043, JP-A-61-43743, and JP-A-61-42657; the light-sensitive materials having a form in which a light sensitive layer is separated into two or more layers each having the same spectral sensitivity, as described in JP-B 49-15495 and U.S. Pat. No. 3,843,469; and the light-sensitive materials in which the arrangement of a high sensitive layer and a low sensitive layer is controlled and the arrangement of the layers each having a different color sensitivity is controlled, as described in JP-B-53-37017 and JP B-53-37018, and JP-A-51-49027, JP-A-52-143016, JP-A-53-97831, JP-A-62-200350, and JP-A-59-177551.

A suitable support which can be used in the present invention is described in, for example, above *RD* No. 17643, p. 28, and *RD* No. 18716, a right column at p. 647 to a left column at p. 648.

The light-sensitive material according to the present invention can be subjected to conventional development processing described in *Research Disclosure,* No. 17643, pp. 28 to 29, and ibid. No. 18716, left column to right column at p. 651.

The color developing solution used for the development processing of the light-sensitive material of the present invention is preferably an alkaline aqueous solution containing an aromatic primary amine color developing agent as a primary component. An aminophenol compound is also useful as the color developing agent but a p-phenylenediamine type compound is preferably used. Representative examples thereof include 3-methyl-4-amino-N,N-diethylaniline, 3-methyl-4-amino-N-ethyl N-β-hydroxyethylaniline, 3-methyl-4-amino-N-ethyl-N-8-methanesulfonamidoethylaniline, 3-methyl-4-amino-N-ethyl-N-8-methoxyethylaniline, and sulfates, hydrochlorides and p-toluenesulfonates thereof. These compounds can also be used as a combination of two or more kinds thereof.

In general, the color developing solution contains a pH buffer agent such as carbonates, borates and phosphates of alkali metals, and a development inhibitor or anti-foggant such as bromides, iodides, benzimidazoles, benzothiazoles, and mercapto compounds. Further, as desired, hydroxylamine, diethyl-hydroxyl amine, sulfite, hydrazines, phenyl semicarbazides, triethanolamine and catecholsulfonic acids, various preservatives such as triethylenediamine (1.4-diazabicyclo[2,2,2]octane), an organic solvent such as ethylene glycol and diethylene glycol, a development accelerator such as benzyl alcohol, polyethylene glycol, a quaternary ammonium salt and amines, a dye-forming coupler, a competitive coupler, a fogging agent such as sodium boron hydride, an auxiliary developing agent such as 1-phenyl-3-pyrazolidone, a tackifier, and various chelating agents represented by amino polycarboxylic acid, amino polyphosphonic acid, alkylphosphonic acid, and phosphonocarboxylic acid, for example, ethylenediaminetetracetic acid, nitrilotriactic acid, diethylenetriaminepentacetic acid, cyclohexanediaminetetracetic acid, hydroxyethyliminodiacetic acid, 1-hydroxyethylidene-1,1-diphosphonic acid, nitrilo-N,N,N-trimethylenephosphonic acid, ethylenediamine-N,N,N',N-tetramethylenephosphonic acid, ethylenediamine-di(o-hydroxyphenylacetic acid), and the salts thereof can be added to the color developing solution.

In carrying out reversal processing, color development is usually carried out after black-and-white development. Conventionally known black-and-white developing agents such as dihydroxybenzenes including hydroquinone, 3-pyrazolidones including 1-phenyl-3-pyrazolidone, and aminophenols including N-methyl p-aminophenol can be used alone or in combination as this black-and-white developing solution.

In general, the pH of these color developing agents and black-and-white developing agents is 9 to 12.

The replenishing amount of these developing solutions depends on the color photographic light-sensitive material to be processed. In general, it is 3 liters or less per $m^2$ of a light-sensitive material, and it also is possible to reduce it to 500 ml per $m^2$ of a light-sensitive material by keeping the bromide ion concentration present in a replenishing solution reduced. In order to reduce the replenishing amount, the area of the processing bath in contact with air is preferably reduced to thereby prevent evaporation and air oxidation of the processing solution. Further, means for controlling the accumulation of a bromide ion in the developing solution can be used to reduce the replenishing solution.

The time for a color development processing is usually set in the range of 2 to 5 minutes. The temperature and pH can be increased and the color developing agent can be used at a higher concentration to thereby enable a processing time to be further shortened.

The photographic emulsion layer is usually subjected to a bleaching treatment after color development. The bleaching treatment may be carried out at the same time as the fixing treatment (as a bleach-fixing processing) or may be independently carried out. Further, a processing method in which a bleach-fixing treatment is carried out after the bleaching treatment in order to accelerate the processing can be employed. Further, according to the purposes, the processing can be in a continuous two baths bleach-fixing bath, the fixing processing can be before the bleach-fixing processing, or the bleaching processing can be after the bleach-fixing processing. The compounds of polyvalent metals such as iron (III), cobalt (III), chromium (IV) and copper (II), peracids, quinones, and nitro compounds can be used as a bleaching agent, for example. Representative bleaching agents which can be used are a ferricyanide compound; bichromate; an organic complex salt of iron (III) or cobalt (III), for example, the complex salts of aminopolycarboxylic acids such as ethylenediaminetetraacetic acid, diethylenetriaminepentacetic acid, cyclohexanediaminetetracetic acid, methyliminodiacetic acid, 1,3-diamino-2-propanoltetracetic acid, and glycol ether diamineteracetic acid, or the complex salts of citric acid, tartaric acid and malic acid; persulfates; bromates; permanganates; and nitrobenzenes. Of them, an iron (III) aminopolycarboxylic acid complex salt, and persulfate including an iron (III) ethylenediaminetetraacetic acid complex salt are preferred from the standpoint of rapid processing and prevention of environmental pollution. Further, an iron (III) aminopolycarboxylic acid complex salt is particularly useful for either a bleaching solution or a bleach-fixing solution. The pH of the bleaching solution or the bleach-fixing solution each containing these iron (III) aminopolycarboxylic acid complex salts is generally from 5.5 to 8. In order to accelerate the processing, the processing can be carried out at much lower pH.

A bleaching accelerator can be used in a bleaching bath, a bleach-fixing bath and a preceding bath thereof as necessary. Specific examples of useful bleaching accelerators are as follows: the compounds having a mercapto group or a disulfide group, described in U.S. Pat. No. 3,893,858, German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, and JP-A-53-28426, and *Research Disclosure* No. 17129 (July 1978); the thiazolidine derivatives described in JP-A-50-140129; the thiourea derivatives described in JP-B-45-8506, JP-A-52-20832 and JP-A-53-32735, and U.S. Pat. No. 3,706,561; the iodides described in German Patent 1,127,715 and JP-A-58-16235; the polyoxyethylene compounds described in German Patents 966,410 and 2,748,730; the polyamine compounds described in JP-B-45-8836; and the compounds described in JP-A-49-42434, JP-A-49-59644, JP-A-53-94927, JP-A-54-35727, JP-A-55-26506, and JP-A-58-163940; and a bromine ion. Of these compounds, the compounds having a mercapto group or a disulfide group are preferred from the standpoint of larger bleaching acceleration effect. Particularly preferred are the compounds described in U.S. Pat. No. 3,893,858, German Patent 1,290,812, and JP-A-53-95630. Further, the compounds described in U.S. Pat. No. 4,552,834 are also preferred. These bleaching accelerators may also be incorporated into a light-sensitive material. These bleaching accelerators are particularly useful when a color light-sensitive material for photography is bleached and fixed.

Thiosulfates, thiocyanates, thioether compounds, thioureas, and numerous iodides are examples of suitable fixing agents. Of them, thiosulfates are generally used. In particular, ammonium thiosulfate is most widely used. Sulfites, bisulfites or carbonyl bisulfite adducts are preferred as preservatives for a bleach-fixing solution.

The silver halide color light-sensitive material according to the present invention is generally subjected to a washing step and/or a stabilizing step after a desilvering step. The amount of washing water in the washing step can be varied over a wide range according to the various conditions such as the characteristics of the light-sensitive material (for example, depending on the materials present such as a coupler), the applications thereof, a temperature of the washing water, the number of washing tanks (the number of washing stages), the replenishing manner such as countercurrent or concurrent, and other factors. The relationship of the number of the tanks for washing to water quantity in a multi-stage countercurrent flow system can be determined by the method described in *Journal of the Society of Motion Picture and Television Engineers,* vol. 64, pp. 248 to 253 (May 1955).

The amount of washing water can be decreased to a large extent depending on the multi-stage counter-current flow system described in the above literature. However, the increased residence time of the water in the tanks allows bacteria to grow causing the problem that floating matters formed thereby adhere to the light-sensitive material. In the processing of the light-sensitive material according to the present invention, the method for reducing calcium and magnesium ions described in JP-A-62-288838 can be quite effectively used as a means for solving this problem. Also, the isothiazolone compounds and thiabendazoles described in JP-A-57-8542, chlorine bactericides such as chlorinated sodium isocyanurate, and benzotriazoles and other bactericides, described in *Chemistry of Anti bacteria and Anti-molds,* H. Horiguchi, *Disinfection and Anti-mold Technology of Microbials,* Hygiene Technology Institute (1982), and *Bactericide and Fungicide Dictionary,* Japan Anti-bacteria and Anti-mold Society (1986).

Washing water in the processing of the light-sensitive material according to the present invention has a pH of 4 to 9, preferably 5 to 8. The washing temperature and a washing time also can be varied depending on the characteristics of the light-sensitive material, the application thereof, etc. In general, the ranges of 15° to 45° C. and 20 seconds to 10 minutes, preferably 25° to 40° C. and 30 seconds to 5 minutes are selected. Further, the light-sensitive material according to the present invention can also be directly processed in a stabilizing solution in place of washing water. All of the conventionally known methods described in JP-A-57-8543, JP-A-58-14834, and JP-A-60-220345 can be used in such a stabilizing processing.

In some cases, a stabilizing processing is further carried out following the above washing processing, and an example thereof comprises a stabilizing bath used as the final bath for a light-sensitive material for photographing, which contains formaldehyde and a surface active agent. Various chelating agents and anti-mold agents can be added as well to this stabilizing bath.

The overflow solution generated in the replenishing of the above washing and/or stabilizing solutions can be reused in the other steps such as a desilvering step.

A color developing agent may also be incorporated into the silver halide color light-sensitive material according to the present invention for the purposes of a simplification and acceleration of the processing. Various precursors of developing agents can be advantageously used for the incorporation thereof. There can be given, for example, the indoaniline compounds described in U.S. Pat. No. 3,342,597, the Schiff base type compounds described in U.S. Pat. No. 3,342,599, and *Research Disclosure,* No. 14,850 and ibid. No. 15,159, the aldol compounds described in *Research Disclosure,* No. 13,924, the metal salt complexes described in U.S. Pat. No. 3,719,492, and the urethane compounds described in JP-A-53-135628.

Various 1-phenyl-3-pyrazolidones may be incorporated into the silver halide color light-sensitive material according to the present invention for the purpose of accelerating color development as desired. Typical compounds are described in JP-A-56-64339, JP-A-57-144547, and JP-A-58-115438.

In the present invention, various processing solutions are used at 10° to 50° C. Usually, a temperature of 33° to 38° C. is standard. The temperature can be higher to accelerate a processing for shortening a processing time. On the contrary, the temperature can be decreased to achieve an increase in image quality and an improvement in the stability of the processing solution. Further, for the sake of conserving silver in a light-sensitive material, a processing in which a cobalt intensification or hydrogen peroxide intensification is used, as described in German Patent 2,226,770 and U.S. Pat. No. 3,674,499 may be carried out.

The silver halide light-sensitive material according to the present invention can be applied as well to a heat developable light-sensitive material described in U.S. Patent 4,500,626, JP-A-60-133449, JP-A-59-218443, and JP-A-61-238056, and European Patent 210,660A2.

EXAMPLES

Eamples of the present invention are shown below but the scope of the present invention is not to be construed as limited thereto. Unless otherwise indicated herein, all parts, percents, ratios and the like are by weight.

EXAMPLE 1

Preparation of Sample 101

Layers having the following compositions were provided on a 127 μm thick cellulose triacetate film support having thereon a subbing layer to thereby prepare a multi-layered color light-sensitive material Sample 101. The numerals show the addition amounts per $m^2$. The effects of the compounds added are not limited to the applications described.

| | |
|---|---|
| First Layer: anti-halation layer | |
| Black colloidal silver | 0.20 g |
| Gelatin | 1.9 g |
| UV absorber U-1 | 0.1 g |
| UV absorber U-3 | 0.04 g |
| UV absorber U-4 | 0.1 g |
| High-boiling organic solvent Oil-1 | 0.1 g |
| Fine crystal solid matter dispersion of Dye E-1 | 0.1 g |
| Second Layer: intermediate layer | |
| Gelatin | 0.40 g |
| Compound Cpd-C | 5 mg |
| Compound Cpd-J | 5 mg |
| Compound Cpd-K | 3 mg |
| High-boiling organic solvent Oil-3 | 0.1 g |
| Dye D-4 | 0.4 mg |
| Third Layer: intermediate layer | |
| Silver bromoiodide fine grain emulsion whose grain surface and inside were fogged (average grain size: 0.06 μm, variation coefficient: 18%, AgI content: 1 mole %) | silver amount 0.05 g |
| Gelatin | 0.4 g |
| Fourth Layer: low sensitivity red-sensitive emulsion layer | |
| Emulsion A | silver amount 0.1 g |
| Emulsion B | silver amount 0.4 g |
| Gelatin | 0.8 g |
| Coupler C-1 | 0.15 g |
| Coupler C-2 | 0.05 g |
| Coupler C-3 | 0.05 g |
| Coupler C-9 | 0.05 g |
| Compound Cpd-C | 10 mg |
| High-boiling organic solvent Oil-2 | 0.1 g |
| Additive P-1 | 0.1 g |
| Fifth Layer: medium sensitivity red-sensitive emulsion layer | |

-continued

| | |
|---|---|
| Emulsion B | silver amount 0.2 g |
| Emulsion C | silver amount 0.3 g |
| Gelatin | 0.8 g |
| Coupler C-1 | 0.2 g |
| Coupler C-2 | 0.05 g |
| Coupler C-3 | 0.2 g |
| High-boiling organic solvent Oil-2 | 0.1 g |
| Additive P-1 | 0.1 g |
| Sixth Layer: high sensitivity red-sensitive emulsion layer | |
| Emulsion D | silver amount 0.4 g |
| Gelatin | 1.1 g |
| Coupler C-1 | 0.3 g |
| Coupler C-2 | 0.1 g |
| Coupler C-3 | 0.7 g |
| Additive P-1 | 0.1 g |
| Seventh Layer: intermediate layer | |
| Gelatin | 0.6 g |
| Additive M-1 | 0.3 g |
| Anti-color mixing agent Cpd-I | 2.6 mg |
| UV absorber U-1 | 0.01 g |
| UV absorber U-2 | 0.002 g |
| UV absorber U-5 | 0.01 g |
| Dye D-1 | 0.02 g |
| Compound Cpd-C | 5 mg |
| Compound Cpd-J | 5 g |
| Compound Cpd-K | 5 g |
| High-boiling organic solvent Oil-1 | 0.02 g |
| Eighth Layer: intermediate layer | |
| Silver bromoiodide emulsion whose grain surface and inside were fogged (average grain size: 0.06 μm, variation coefficient: 16%, AgI content: 0.3 mole %) | silver amount 0.02 g |
| Gelatin | 1.0 g |
| Additive P-1 | 0.2 g |
| Anti-color mixing agent Cpd-A | 0.1 g |
| Ninth Layer: low sensitivity green-sensitive emulsion layer | |
| Emulsion E | silver amount 0.1 g |
| Emulsion F | silver amount 0.2 g |
| Emulsion G | silver amount 0.2 g |
| Gelatin | 0.5 g |
| Coupler C-4 | 0.1 g |
| Coupler C-7 | 0.05 g |
| Coupler C-8 | 0.20 g |
| Compound Cpd-B | 0.03 g |
| Compound Cpd-C | 10 mg |
| Compound Cpd-D | 0.02 g |
| Compound Cpd-E | 0.02 g |
| Compound Cpd-F | 0.02 g |
| Compound Cpd-G | 0.02 g |
| High-boiling organic solvent Oil-1 | 0.1 g |
| High-boiling organic solvent Oil-2 | 0.1 g |
| Tenth Layer: medium sensitivity green-sensitive emulsion layer | |
| Emulsion G | silver amount 0.3 g |
| Emulsion H | silver amount 0.1 g |
| Gelatin | 0.6 g |
| Coupler C-4 | 0.1 g |
| Coupler C-7 | 0.2 g |
| Coupler C-8 | 0.1 g |
| Compound Cpd-B | 0.03 g |
| Compound Cpd-D | 0.02 g |
| Compound Cpd-E | 0.02 g |
| Compound Cpd-F | 0.05 g |
| Compound Cpd-G | 0.05 g |
| High-boiling organic solvent Oil-2 | 0.01 g |
| Eleventh Layer: high sensitivity green-sensitive emulsion layer | |
| Emulsion I | silver amount 0.5 g |
| Gelatin | 1.0 g |
| Coupler C-4 | 0.3 g |
| Coupler C-7 | 0.1 g |
| Coupler C-8 | 0.1 g |
| Compound Cpd-B | 0.08 g |
| Compound Cpd-C | 5 mg |
| Compound Cpd-D | 0.02 g |
| Compound Cpd-E | 0.02 g |

-continued

| | |
|---|---|
| Compound Cpd-F | 0.02 g |
| Compound Cpd-G | 0.02 g |
| Compound Cpd-J | 5 mg |
| Compound Cpd-K | 5 mg |
| High-boiling organic solvent Oil-1 | 0.02 g |
| High-boiling organic solvent Oil-2 | 0.02 g |
| Twelfth Layer: intermediate layer | 0.6 g |
| Gelatin | |
| Thirteenth Layer: yellow filter layer | |
| Yellow colloidal silver | silver amount 0.07 g |
| Gelatin | 1.1 g |
| Anti-color mixing agent Cpd-A | 0.01 g |
| High-boiling organic solvent Oil-1 | 0.01 g |
| Fine crystal solid matter dispersion of Dye E-2 | 0.05 g |
| Fourteenth Layer: intermediate layer | 0.6 g |
| Gelatin | |
| Fifteenth Layer: low sensitivity blue-sensitive emulsion layer | |
| Emulsion J | silver amount 0.2 g |
| Emulsion K | silver amount 0.3 g |
| Emulsion L | silver amount 0.1 g |
| Gelatin | 0.8 g |
| Coupler C-5 | 0.2 g |
| Coupler C-6 | 0.1 g |
| Coupler C-10 | 0.4 g |
| Sixteenth Layer: medium sensitivity blue-sensitive emulsion layer | |
| Emulsion L | silver amount 0.1 g |
| Emulsion M | silver amount 0.4 g |
| Gelatin | 0.9 g |
| Coupler C-5 | 0.3 g |
| Coupler C-6 | 0.1 g |
| Coupler C-10 | 0.1 g |
| Seventeenth Layer: high sensitivity blue-sensitive emulsion layer | |
| Emulsion N | silver amount 0.4 g |
| Gelatin | 1.2 g |
| Coupler C-5 | 0.3 g |
| Coupler C-6 | 0.6 g |
| Coupler C-10 | 0.1 g |
| Eighteenth Layer: first protective layer | |
| Gelatin | 0.7 g |
| UV absorber U-1 | 0.2 g |
| UV absorber U-2 | 0.05 g |
| UV absorber U-5 | 0.3 g |
| Formalin scavenger Cpd-H | 0.4 g |
| Dye D-1 | 0.1 g |
| Dye D-2 | 0.05 g |
| Dye D-3 | 0.1 g |
| Nineteenth Layer: second protective layer | |
| Colloidal silver | silver amount 0.1 mg |
| Silver bromoiodide fine grain emulsion (average grain size: 0.06 μm, AgI content: 1 mole %) | silver amount 0.1 g |
| Gelatin | 0.4 g |
| Twentieth Layer: third protective layer | |
| Gelatin | 0.4 g |
| Polymethyl methacrylate (average grain size: 1.5 μm) | 0.1 g |
| Copolymer of methyl methacrylate and acrylic acid (4:6) (average grain size: 1.5 μm) | 0.1 g |
| Silicone oil | 0.03 g |
| Surface active agent W-1 | 3.0 mg |
| Surface active agent W-2 | 0.03 g |

In addition to the above components, additives F-1 to F-8 were added to all of the layers. Further, in addition to the above components, gelatin hardener H-1 and surface active agents W-3, W-4, W-5 and W-6 for coating and emulsifying were added to each of the layers.

Further, phenol, 1,2-benzisothiazoline-3-one, 2-phenoxyethanol, and phenethyl alcohol were added as a fungicide and an anti-mold agent.

TABLE 1

The silver bromoiodide emulsions used for Sample 101 are as follows:

| Emulsion | Average* Grain Size (μm) | Variation Coefficient (%) | AgI Content (%) |
|---|---|---|---|
| A. Monodisperse tetradecahedral grains | 0.28 | 16 | 3.7 |
| B. Monodisperse cubic, internal latent image type grains | 0.30 | 10 | 3.3 |
| C. Monodisperse tabular grains, average aspect ratio: 4.0 | 0.38 | 18 | 5.0 |
| D. Tabular grains average aspect ratio: 8.0 | 0.68 | 25 | 2.0 |
| E. Monodisperse cubic grains | 0.20 | 17 | 4.0 |
| F. Monodisperse cubic grains | 0.23 | 16 | 4.0 |
| G. Monodisperse cubic, internal latent image type grains | 0.28 | 11 | 3.5 |
| H. Monodisperse cubic, internal latent image type grains | 0.32 | 9 | 3.5 |
| I. Tabular grains average aspect ratio: 9.0 | 0.80 | 28 | 1.5 |
| J. Monodisperse tetradecahedral grains | 0.30 | 18 | 4.0 |
| K. Monodisperse tabular grains, average aspect ratio: 7.0 | 0.45 | 17 | 4.0 |
| L. Monodisperse cubic, internal latent image type grains | 0.46 | 14 | 3.5 |
| M. Monodisperse tabular grains, average aspect ratio: 10.0 | 0.55 | 13 | 4.0 |
| N. Tabular grains average aspect ratio: 12.0 | 1.00 | 33 | 1.3 |

*Circle-corresponding average grain size.

TABLE 2

Spectral sensitization of Emulsions A to J

| Emulsion | Sensitizing Dye Added | Added Amount per mol of AgX (g) |
|---|---|---|
| A | S-7 | 0.285 |
| B | S-7 | 0.27 |
| C | S-7 | 0.28 |
| D | S-7 | 0.27 |
| E | S-3 | 0.5 |
| | S-4 | 0.1 |
| F | S-3 | 0.3 |
| | S-4 | 0.1 |
| G | S-3 | 0.25 |
| | S-4 | 0.08 |
| | S-8 | 0.05 |
| H | S-3 | 0.2 |
| | S-4 | 0.06 |
| | S-8 | 0.05 |
| I | S-3 | 0.3 |
| | S-4 | 0.07 |
| | S-8 | 0.1 |
| J | S-6 | 0.2 |
| | S-5 | 0.05 |

TABLE 3

Spectral sensitization of Emulsions K to N

| Emulsion | Sensitizing Dye Added | Added Amount per mol of AgX |
|---|---|---|
| K | S-6 | 0.2 |
| | S-5 | 0.05 |
| L | S-6 | 0.22 |
| | S-5 | 0.06 |
| M | S-6 | 0.15 |
| | S-5 | 0.04 |
| N | S-6 | 0.22 |
| | S-5 | 0.06 |

C-1

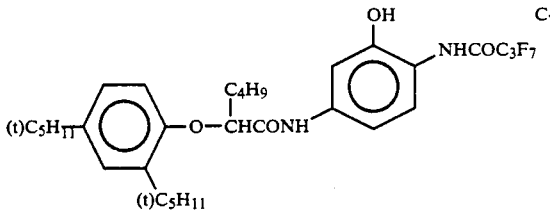

C-2

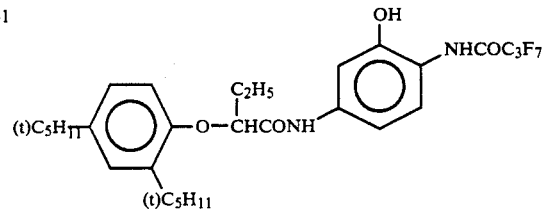

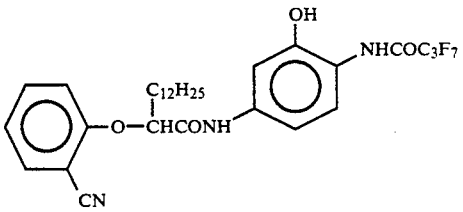

C-3

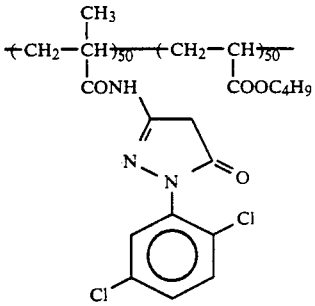

Numerals: weight %
Average molecular weight: about 25,000

-continued
C-5
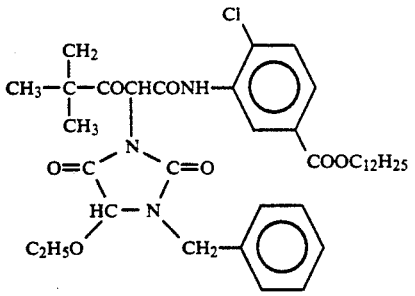
C-6
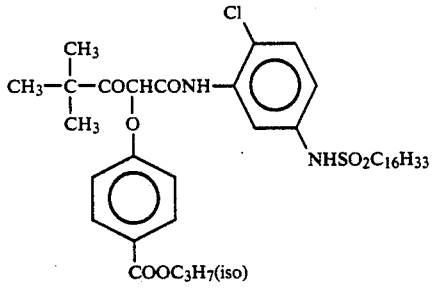
C-7
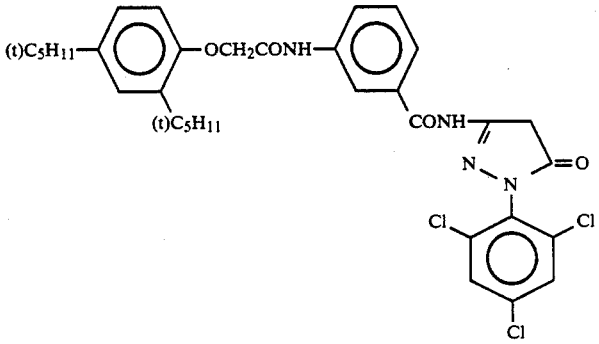
C-8
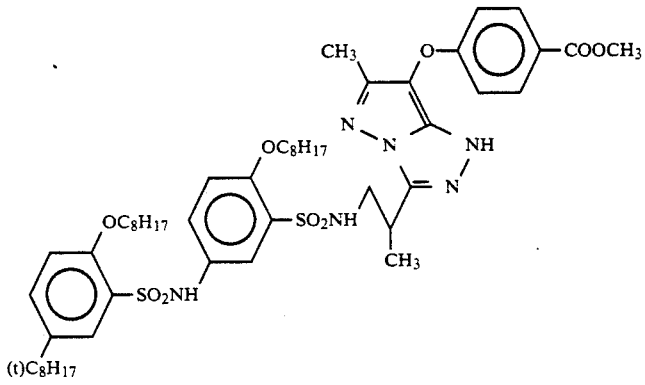
C-9
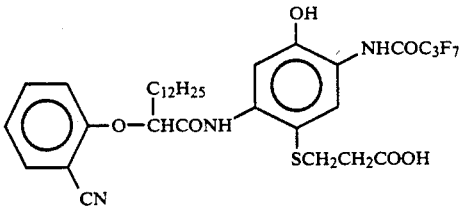
C-10
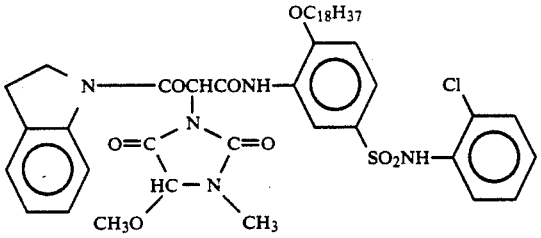
Dibutyl phthalate Oil-1
Tricresyl phosphate Oil-2
Oil-3
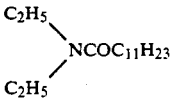
Cpd-A
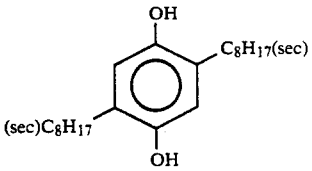

-continued
Cpd-B
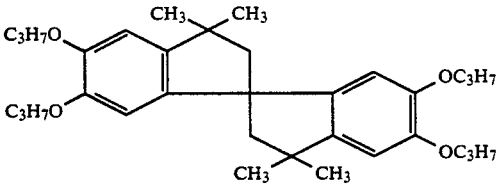
Cpd-C
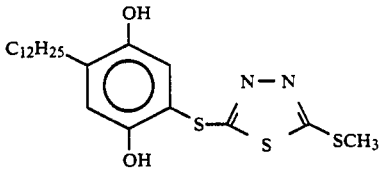
Cpd-D
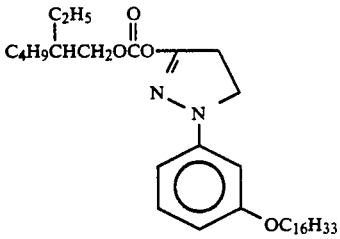
Cpd-E
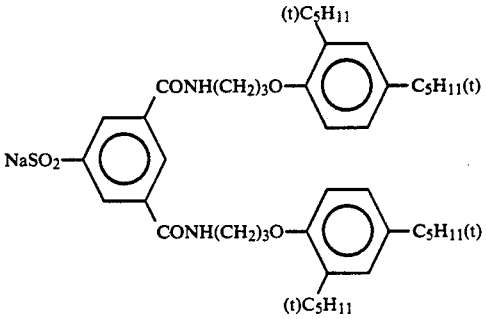
Cpd-F
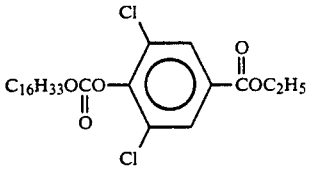
Cpd-G
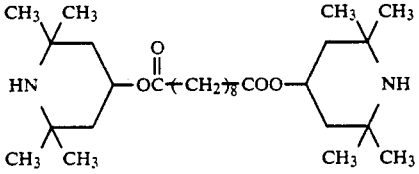
Cpd-H
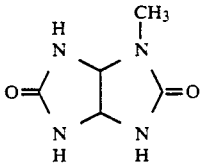
Cpd-I
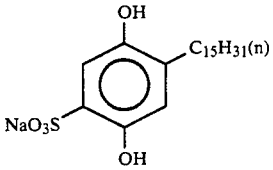
Cpd-J
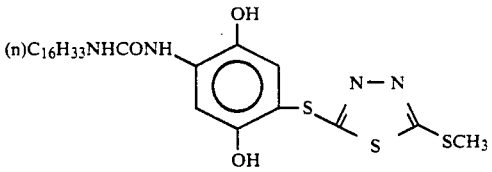
Cpd-K
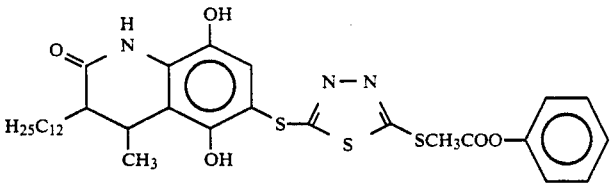
U-1
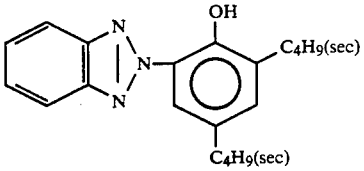
U-2
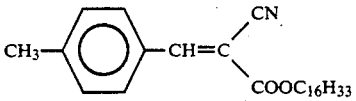
U-3
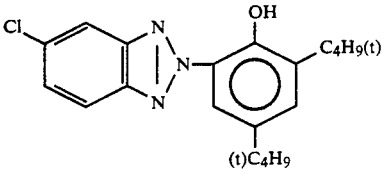
U-4
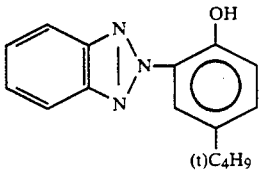

-continued
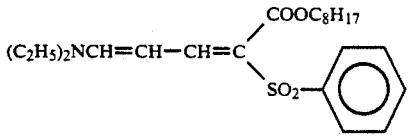
U-5
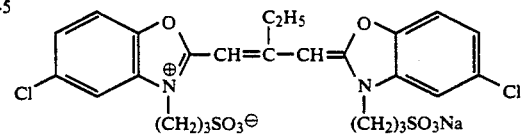
S-3
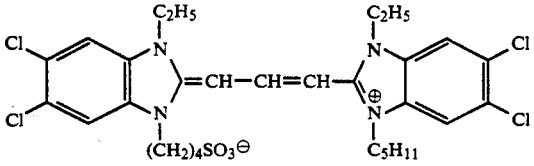
S-4
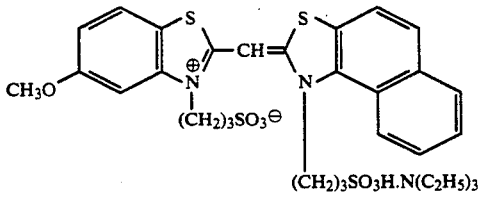
S-5
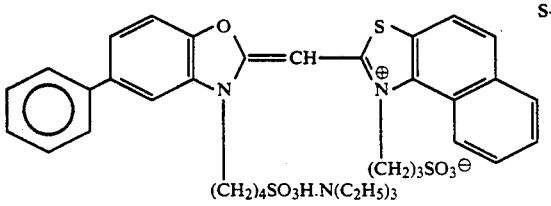
S-6
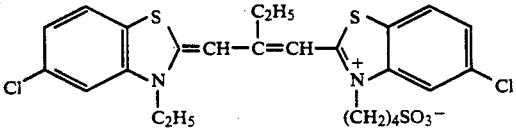
S-7
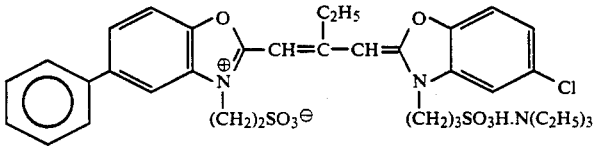
S-8
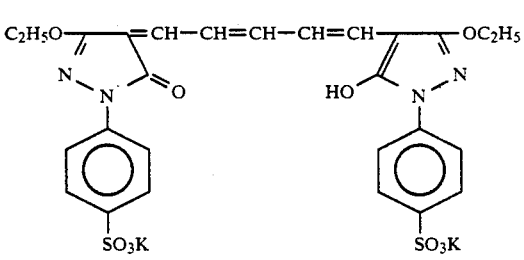
D-1
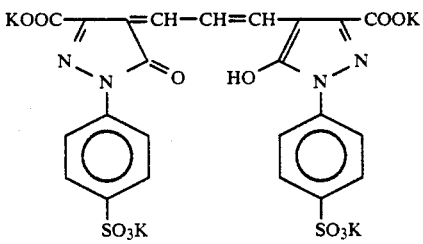
D-2
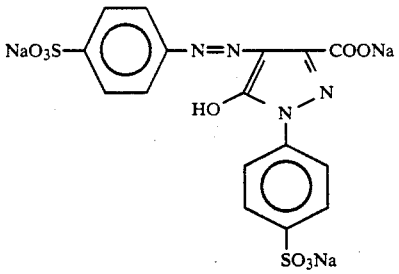
D-3
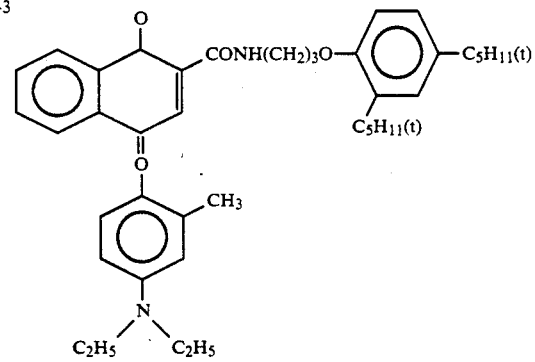
D-4
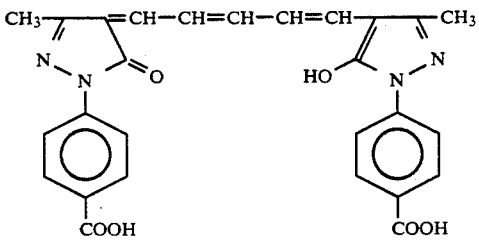
E-1
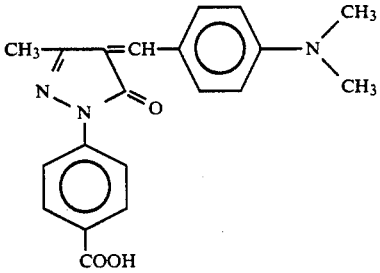
E-2

-continued

H-1

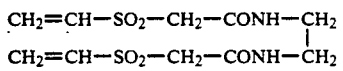

W-1

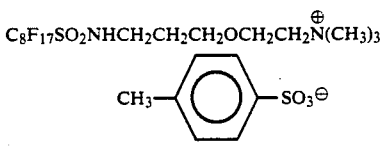

W-2

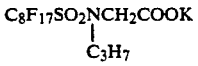

W-3

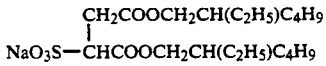

W-4

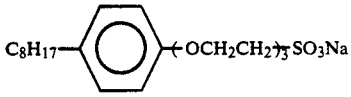

W-5

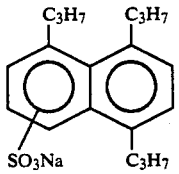

W-6

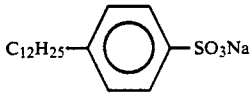

P-1

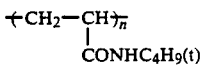

M-1

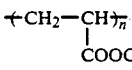

F-1

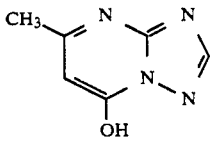

F-2

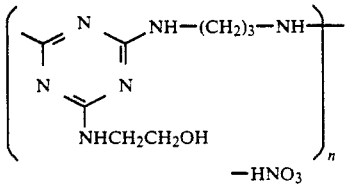

F-3

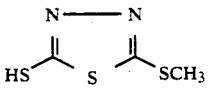

F-4

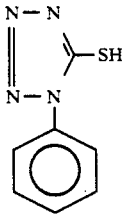

F-5

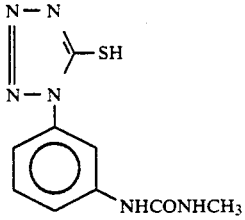

F-6

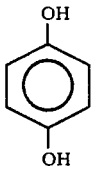

F-7

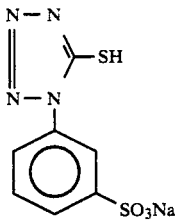

F-8

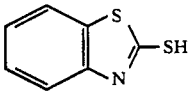

Preparation of Samples 102 to 117

The sensitizing dyes for Emulsions A to D used in Sample 101 were replaced as shown in Table 4 below, whereby Samples 102 to 109 were prepared.

The samples thus prepared were exposed to a white light via a grey wedge at an exposure amount of 20 CMS and an exposure time of 1/100 second and then processed using the following steps for sensitometry.

Further, the density of the magenta stain of Sample 109 (dye blank) was deducted from the magenta density of stain of the sample pieces processed to thereby evaluate residual color.

TABLE 4

| Sample No. | Emulsion A Sensitizing Dye | Emulsion A Added Amount (g/mole Ag) | Emulsion B or D Sensitizing Dye | Emulsion B or D Added Amount (g/mole Ag) | Emulsion C Sensitizing Dye | Emulsion C Added Amount (g/mole Ag) |
|---|---|---|---|---|---|---|
| 101 | S-7 | 0.285 | S-7 | 0.270 | S-7 | 0.280 |
| 102 | I-1 | 0.285 | I-1 | 0.270 | I-1 | 0.280 |
| 103 | II-1 | 0.285 | II-1 | 0.270 | II-1 | 0.280 |
| 104 | I-1 | 0.270 | I-1 | 0.257 | I-1 | 0.266 |
| | II-1 | 0.015 | II-1 | 0.013 | II-1 | 0.014 |
| 105 | I-1 | 0.270 | I-1 | 0.257 | I-1 | 0.266 |
| | III-1 | 0.015 | III-1 | 0.013 | III-1 | 0.014 |
| 106 | I-1 | 0.273 | I-1 | 0.260 | I-1 | 0.268 |
| | II-1 | 0.006 | II-1 | 0.005 | II-1 | 0.006 |
| | III-1 | 0.006 | III-1 | 0.005 | III-1 | 0.006 |
| 107 | I-4 | 0.273 | I-4 | 0.260 | I-4 | 0.268 |
| | II-4 | 0.006 | II-4 | 0.005 | II-4 | 0.006 |
| | III-4 | 0.006 | III-4 | 0.005 | III-4 | 0.006 |
| 108 | I-7 | 0.273 | I-7 | 0.260 | I-7 | 0.268 |
| | II-7 | 0.006 | II-7 | 0.005 | II-7 | 0.006 |
| | III-7 | 0.006 | III-7 | 0.005 | III-7 | 0.006 |
| 109 | — | — | — | — | — | — |

| Processing Step | Time | Temperature |
|---|---|---|
| First developing | 6 minutes | 38° C. |
| Washing | 2 minutes | 38° C. |
| Reversal | 2 minutes | 38° C. |
| Color developing | 6 minutes | 38° C. |
| Controlling | 2 minutes | 38° C. |
| Bleaching | 6 minutes | 38° C. |
| Fixing | 4 minutes | 38° C. |
| Washing | 4 minutes | 38° C. |
| Stabilizing | 1 minute | 25° C. |

The compositions of the respective processing solutions used are shown below:

| First Developing Solution | |
|---|---|
| Pentasodium nitrilo-N,N,N-trimethylenephosphonate | 2.0 g |
| Sodium sulfite | 30 g |
| Hydroquinone.potassium monosulfonate | 20 g |
| Potassium carbonate | 33 g |
| 1-Phenyl-4-methyl-4-hydroxymethyl-3-pyrazolidone | 2.0 g |
| Potassium bromide | 2.5 g |
| Potassium thiocyanate | 1.2 g |
| Potassium iodide | 2.0 mg |
| Water to make | 1000 ml |
| pH | 9.60 |

The pH was adjusted with hydrochloric acid or potassium hydroxide.

| Reversal Solution | |
|---|---|
| Pentasodium nitrilo-N,N,N-trimethylenephosphonate | 3.0 g |
| Stannous chloride dihydrate | 1.0 g |
| p-Aminophenol | 0.1 g |
| Sodium hydroxide | 8 g |
| Glacial acetic acid | 15 ml |
| Water to make | 1000 ml |
| pH | 6.00 |

The pH was adjusted with hydrochloric acid or potassium hydroxide.

| Color Developing Solution | |
|---|---|
| Pentasodium nitrilo-N,N,N-trimethylenephosphonate | 2.0 g |
| Sodium sulfite | 7.0 g |
| Trisodium phosphate 12 hydrate | 36 g |
| Potassium bromide | 1.0 g |
| Potassium iodide | 90 mg |
| Sodium hydroxide | 3.0 g |
| Citrazinic acid | 1.5 g |
| N-ethyl-(β-methanesulfonamidoethyl)-3-methyl-4-aminoanline sulfate | 11 g |
| 3,6-Dithiaoctane-1,8-diol | 1.0 g |
| Water to make | 1000 ml |
| pH | 11.80 |

The pH was adjusted with hydrochloric acid or potassium hydroxide.

| Controlling Solution | |
|---|---|
| Disodium ethylenediamine tetracetate dihydrate | 8.0 g |
| Sodium sulfite | 12 g |
| 1-Thioglycerin | 0.4 ml |
| Water to make | 1000 ml |
| pH | 6.20 |

The pH was adjusted with hydrochloric acid or sodium hydroxide.

| Bleaching Solution | |
|---|---|
| Disodium ethylenediamineteracetate dihydrate | 2.0 g |
| Ammonium ethylenediaminetetracetato ferrate dihydrate | 120 g |
| Potassium bromide | 100 g |
| Ammonium nitrate | 10 g |
| Water to make | 1000 ml |
| pH | 5.70 |

The pH was adjusted with hydrochloric acid or sodium hydroxide.

| Fixing Solution | |
|---|---|
| Ammonium thiosulfate | 80 g |
| Sodium sulfite | 5.0 g |
| Sodium bisulfite | 5.0 g |
| Water to make | 1000 ml |
| pH | 6.60 |

The pH was adjusted with hydrochloric acid or aqueous ammonia.

| Stabilizing Solution | |
|---|---|
| Formaldehyde (37%) | 5.0 ml |
| Polyoxyethylene-p-monononylphenyl ether (average polymerization degree: 10) | 0.5 ml |
| Water to make | 1000 ml |
| pH | not adjusted |

The sensitometry evaluation results and residual color results are shown in the following Table A. Relative sensitivity was compared based on the relative exposure corresponding to a density which is larger than minimum density by 1.0.

TABLE A

| Sample No. | PL Relative Sensitivity | Magenta Residual Color Density |
|---|---|---|
| 101 (Comp.) | 100 | 0.073 |
| 102 (Comp.) | 105 | 0.006 |

TABLE A-continued

| Sample No. | PL Relative Sensitivity | Magenta Residual Color Density |
|---|---|---|
| 103 (Comp.) | 85 | 0.006 |
| 104 (Inv.) | 135 | 0.005 |
| 105 (Inv.) | 133 | 0.007 |
| 106 (Inv.) | 148 | 0.006 |
| 107 (Inv.) | 145 | 0.005 |
| 108 (Inv.) | 140 | 0.007 |
| 109 (Dye blank) | — | 0 |

As is apparent from the results shown in Table A, the use of the compounds and emulsions of the present invention provides light-sensitive materials with less residual color and a higher sensitivity.

EXAMPLE 2

Layers having the following compositions were provided on a cellulose triacetate film support having thereon a subbing layer to thereby prepare a multi-layered color light-sensitive material Sample 201.

Composition of Light-Sensitive Layer

The coated amounts are expressed in terms of g/m$^2$ of silver for silver halide and colloidal silver, in terms of g/m$^2$ for the couplers, additives and gelatin, and in terms of mole per mole of silver halide present in the same layer for the spectral sensitizers.

| | |
|---|---|
| First Layer: anti-halation layer | |
| Black colloidal silver | 0.15 |
| Gelatin | 1.90 |
| ExM-1 | $5.0 \times 10^{-3}$ |
| Second Layer: intermediate layer | |
| Gelatin | 2.10 |
| UV absorber UV-1 | $3.0 \times 10^{-2}$ |
| UV absorber UV-2 | $6.0 \times 10^{-2}$ |
| UV absorber UV-3 | $7.0 \times 10^{-2}$ |
| ExF-1 | $4.0 \times 10^{-3}$ |
| Solv-2 | $7.0 \times 10^{-2}$ |
| Third Layer: low sensitivity red-sensitive emulsion layer | |
| Silver bromoiodide emulsion (AgI: 2 mole %, higher AgI content in inside, circle-corresponding diameter: 0.3 μm, variation coefficient of circle-corresponding diameter: 29%, mixture of regular grains and twin grains, diameter/thickness ratio: 2.5) | silver amount 0.50 |
| Gelatin | 1.50 |
| ExS-10 | $4.1 \times 10^{-4}$ |
| ExC-1 | 0.11 |
| ExC-3 | 0.11 |
| ExC-4 | $3.0 \times 10^{-2}$ |
| ExC-7 | $1.0 \times 10^{-2}$ |
| Solv-1 | $7.0 \times 10^{-3}$ |
| Fourth Layer: medium sensitivity red-sensitive emulsion layer | |
| Silver bromoiodide emulsion (AgI: 4 mole %, higher AgI content in inside, circle-corresponding diameter: 0.55 μm, variation coefficient of circle-corresponding diameter: 20%, mixture of regular grains and twin grains, diameter/thickness ratio: 1.0) | silver amount 0.85 |
| Gelatin | 2.00 |
| ExS-10 | $4.1 \times 10^{-4}$ |
| ExC-1 | 0.16 |
| ExC-2 | $8.0 \times 10^{-2}$ |
| ExC-3 | 0.17 |
| ExC-7 | $1.5 \times 10^{-2}$ |
| ExY-1 | $2.0 \times 10^{-2}$ |
| ExY-2 | $1.0 \times 10^{-2}$ |
| Cpd-10 | $1.0 \times 10^{-4}$ |
| Solv-1 | 0.10 |
| Fifth Layer: high sensitivity red-sensitive emulsion layer | |
| Silver bromoiodide emulsion (AgI: 10 mole %, higher AgI content in inside, circle-corresponding diameter: 0.7 μm, variation coefficient of circle-corresponding diameter: 30%, mixture of regular grains and twin grains, diameter/thickness ratio: 2.0) | silver amount 0.70 |
| Gelatin | 1.60 |
| ExS-10 | $4.1 \times 10^{-4}$ |
| ExC-5 | $7.0 \times 10^{-2}$ |
| ExC-6 | $8.0 \times 10^{-2}$ |
| ExC-7 | $1.5 \times 10^{-2}$ |
| Solv-1 | 0.15 |
| Solv-2 | $8.0 \times 10^{-2}$ |
| Sixth Layer: intermediate layer | |
| Gelatin | 1.10 |
| P-2 | 0.17 |
| Cpd-1 | 0.10 |
| Cpd-4 | 0.17 |
| Solv-1 | $5.0 \times 10^{-2}$ |
| Seventh Layer: low sensitivity green-sensitive emulsion layer | |
| Silver bromoiodide emulsion (AgI: 2 mole %, higher AgI content in inside, circle-corresponding diameter: 0.3 μm, variation coefficient of circle-corresponding diameter: 28%, mixture of regular grains and twin grains, diameter/thickness ratio: 2.5) | silver amount 0.30 |
| Gelatin | 0.50 |
| ExS-1 | $5.0 \times 10^{-4}$ |
| ExS-5 | $2.0 \times 10^{-4}$ |
| ExS-2 | $0.3 \times 10^{-4}$ |
| ExM-1 | $3.0 \times 10^{-2}$ |
| ExM-2 | 0.20 |
| ExY-1 | $3.0 \times 10^{-2}$ |
| Cpd-11 | $7.0 \times 10^{-3}$ |
| Solv-1 | 0.20 |
| Eighth Layer: medium sensitivity green-sensitive emulsion layer | |
| Silver bromoiodide emulsion (AgI: 4 mole %, higher AgI content in inside, circle-corresponding diameter: 0.55 μm, variation coefficient of circle-corresponding diameter: 20%, mixture of regular grains and twin grains, diameter/thickness ratio: 4.0) | silver amount 0.70 |
| Gelatin | 1.00 |
| ExS-1 | $5.0 \times 10^{-4}$ |
| ExS-5 | $2.0 \times 10^{-4}$ |
| ExS-2 | $3.0 \times 10^{-5}$ |
| ExM-1 | $3.0 \times 10^{-2}$ |
| ExM-2 | 0.25 |
| ExM-3 | $1.5 \times 10^{-2}$ |
| ExY-1 | $4.0 \times 10^{-2}$ |
| Cpd-11 | $9.0 \times 10^{-3}$ |
| Solv-1 | 0.20 |
| Ninth Layer: high sensitivity green-sensitive emulsion layer | |
| Silver bromoiodide emulsion (AgI: 10 mole %, higher AgI content in inside, circle-corresponding diameter: 0.7 μm, variation coefficient of circle-corresponding diameter: 30%, mixture of regular grains and twin grains, diameter/thickness ratio: 2.0) | silver amount 0.50 |
| Gelatin | 0.90 |
| ExS-1 | $2.0 \times 10^{-4}$ |
| ExS-5 | $2.0 \times 10^{-4}$ |
| ExS-2 | $2.0 \times 10^{-5}$ |
| ExS-7 | $3.0 \times 10^{-4}$ |
| ExM-1 | $1.0 \times 10^{-2}$ |
| ExM-4 | $3.9 \times 10^{-2}$ |
| ExM-5 | $2.6 \times 10^{-2}$ |
| Cpd-2 | $1.0 \times 10^{-2}$ |
| Cpd-9 | $2.0 \times 10^{-4}$ |
| Cpd-10 | $2.0 \times 10^{-4}$ |
| Solv-1 | 0.20 |
| Solv-2 | $5.0 \times 10^{-2}$ |
| Tenth Layer: yellow filter layer | |
| Gelatin | 0.90 |
| Yellow colloid | $5.0 \times 10^{-2}$ |
| Cpd-1 | 0.20 |
| Solv-1 | 0.15 |
| Eleventh Layer: low sensitivity blue-sensitive emulsion layer | |
| Silver bromoiodide emulsion (AgI: 4 mole %, higher AgI content in inside, circle-corresponding diameter: 0.55 μm, variation coefficient of circle-corresponding diameter: 15%, octahedral grains) | silver amount 0.40 |
| Gelatin | 1.00 |

-continued

| | |
|---|---|
| ExS-4 | $2.0 \times 10^{-4}$ |
| ExY-1 | $9.0 \times 10^{-2}$ |
| ExY-3 | 0.90 |
| Cpd-2 | $1.0 \times 10^{-2}$ |
| Solv-1 | 0.30 |
| Twelfth Layer: high sensitivity blue-sensitive emulsion layer | |
| Silver bromoiodide emulsion (AgI: 10 mole %, higher AgI content in inside, circle-corresponding diameter: 1.3 μm, variation coefficient of circle-corresponding diameter: 25%, mixture of regular grains and twin grains, diameter/thickness ratio: 4.5) | silver amount 0.50 |
| Gelatin | 0.60 |
| ExS-4 | $1.0 \times 10^{-4}$ |
| ExY-3 | 0.12 |
| Cpd-2 | $1.0 \times 10^{-3}$ |
| Solv-1 | $4.0 \times 10^{-2}$ |
| Thirteenth Layer: first protective layer | |
| Silver bromoiodide fine grains (average grain size: 0.07 μm, AgI content: 1 mole %) | 0.20 |
| Gelatin | 0.80 |
| UV-2 | 0.10 |
| UV-3 | 0.10 |
| UV-4 | 0.20 |

-continued

| | |
|---|---|
| Solv-3 | $4.0 \times 10^{-2}$ |
| P-2 | $9.0 \times 10^{-2}$ |
| Fourteenth Layer: second protective layer | |
| Gelatin | 0.90 |
| B-1 (diameter: 1.5 μm) | 0.10 |
| B-2 (diameter: 1.5 μm) | 0.10 |
| B-3 | $2.0 \times 10^{-2}$ |
| H-1 | 0.40 |

Further, in order to improve preservability, processability, anti-pressure property, anti-mold and anti-fungous properties, anti-static property, and coating property, Cpd-3, Cpd-5, Cpd-6, Cpd-7, Cpd-8, P-1, W-1, W-2, and W-3 were added also.

In addition to the above compounds, n butyl-p-hydyoxybenzoate was added. Further, B-4, F-1, F-4, F 5, F-6, F 7, F-8, F-9, F-10, F-11, an iron salt, a lead salt, a gold salt, a platinum salt, an iridium salt, and a rhodium salt were present.

The chemical structures or chemical names of the compounds used in the present invention are shown below:

UV-1

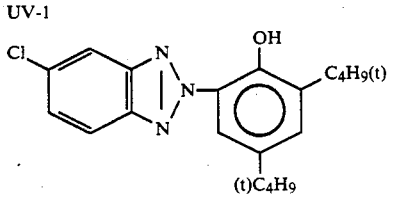

UV-2

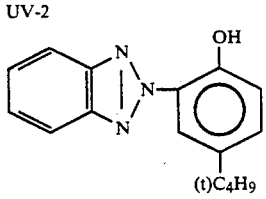

UV-3

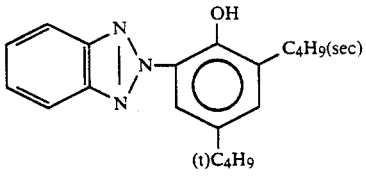

UV-4

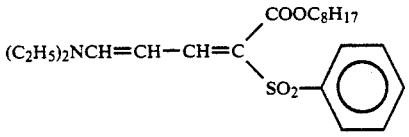

Solv-1
Tricresyl phosphate

Solv-2
Dibutyl phthalate

Solv-3
Tri(2-ethylhexyl) phosphate

ExF-1

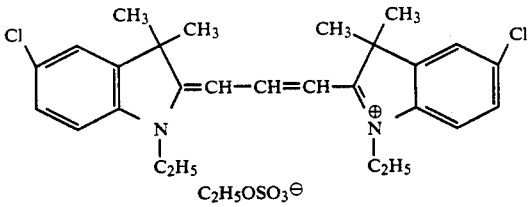

ExC-1

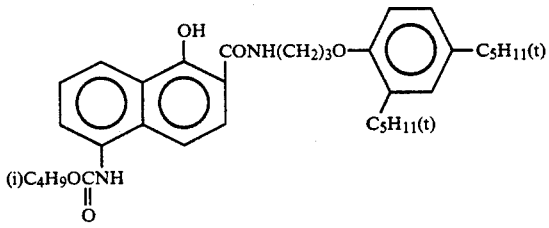

ExC-2

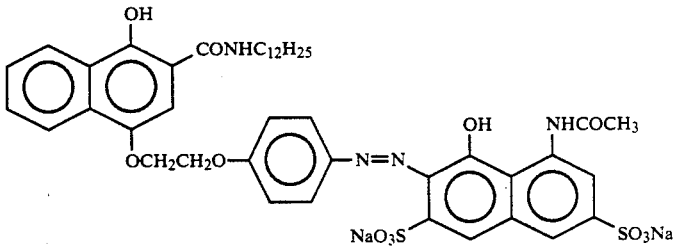

ExC-3

ExC-4

-continued
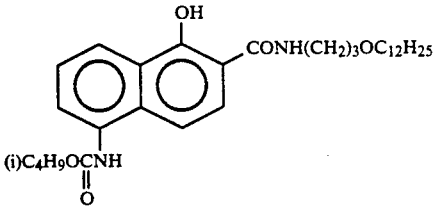
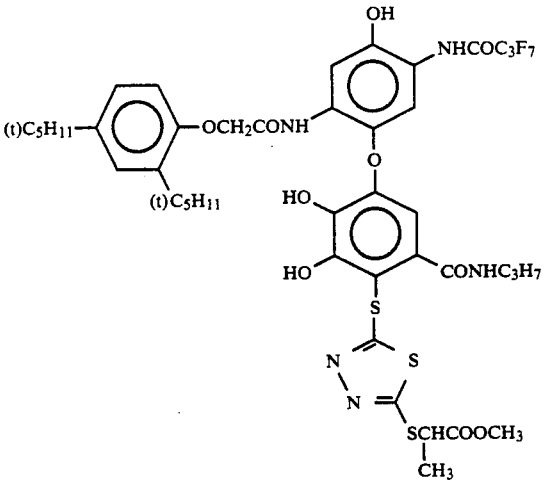
ExC-5
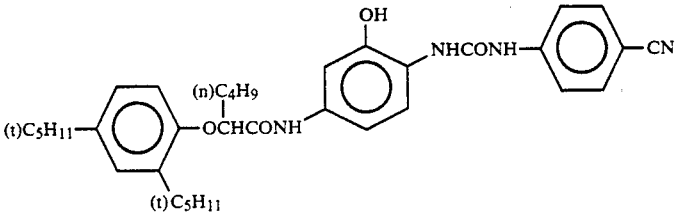
ExC-6
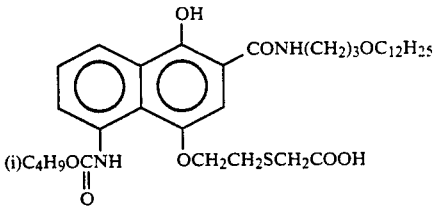
ExC-7
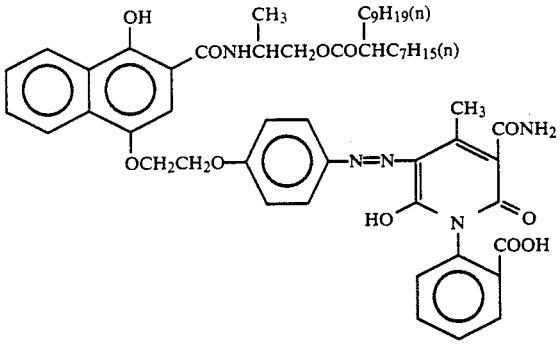
ExM-1
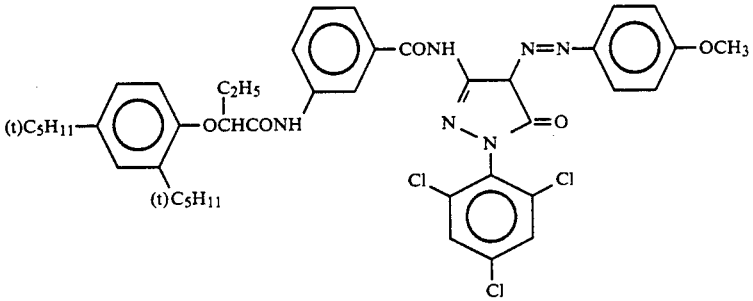
ExM-2

-continued
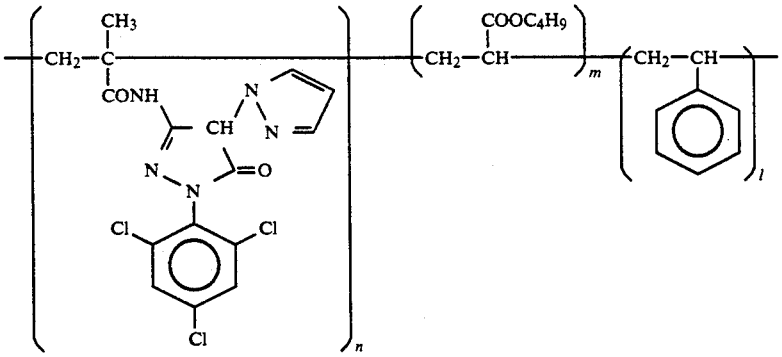
n/m/l = 50/25/25 (by weight) Average molecular weight: 20,000
ExM-3
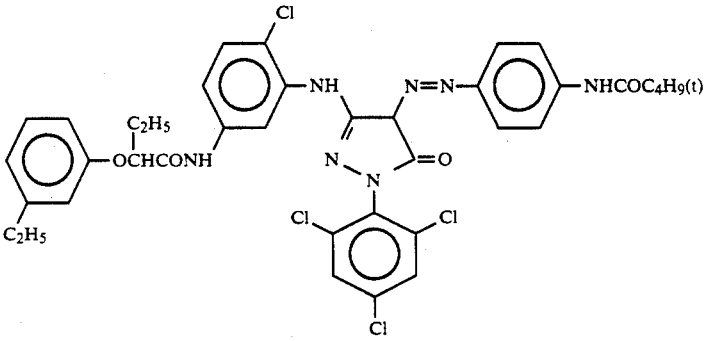
ExM-4
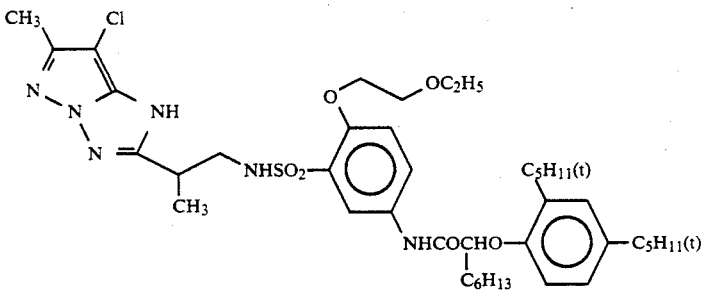
ExM-5
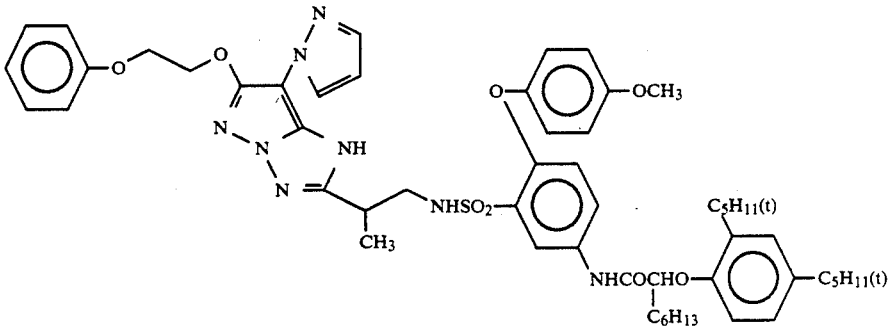
ExY-1

-continued
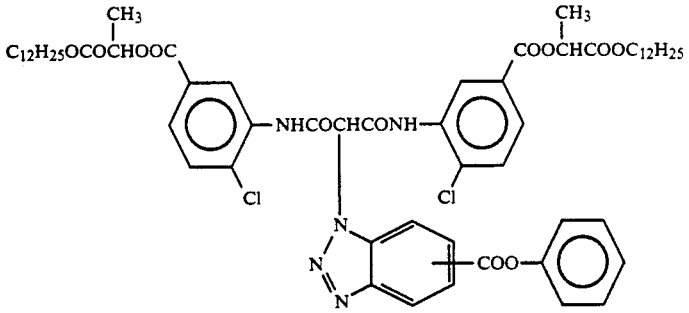
ExY-2
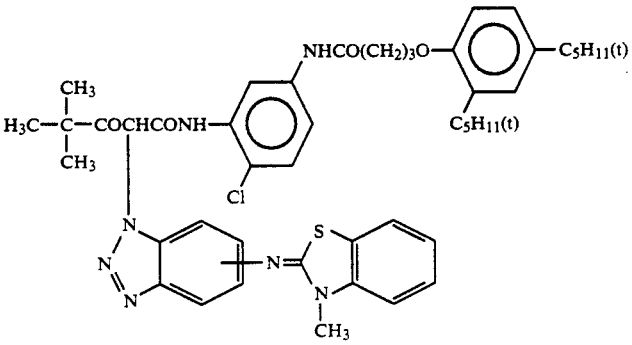
ExY-3
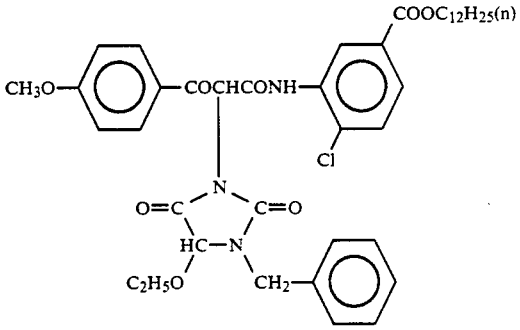
Cpd-1
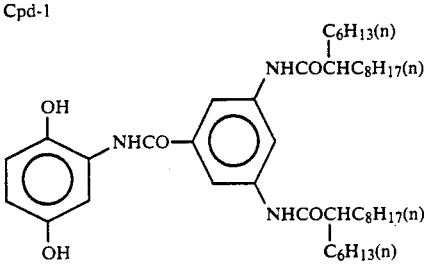
Cpd-2
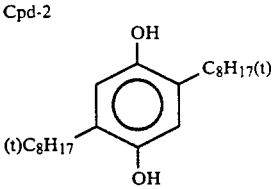
Cpd-3
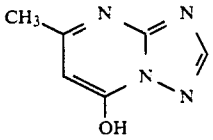
Cpd-4
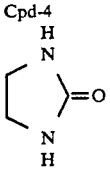
Cpd-5
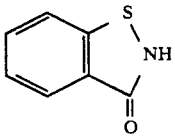
Cpd-6
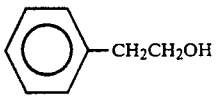
Cpd-7
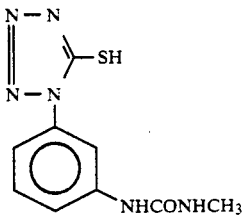

-continued
Cpd-8
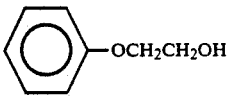
Cpd-9
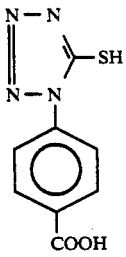
Cpd-10
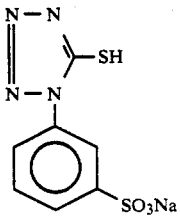
Cpd-11
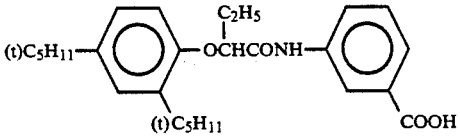
ExS-1
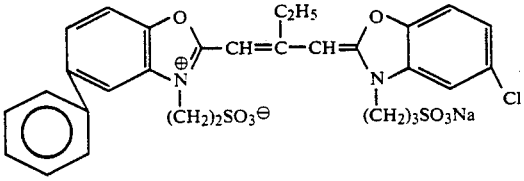
ExS-2
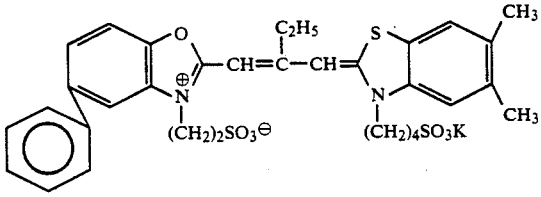
ExS-4
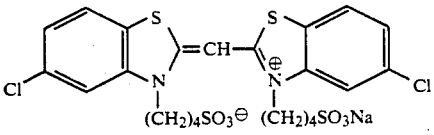
ExS-5
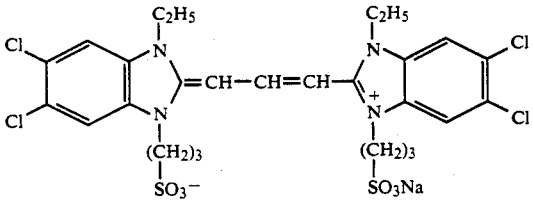
ExS-7
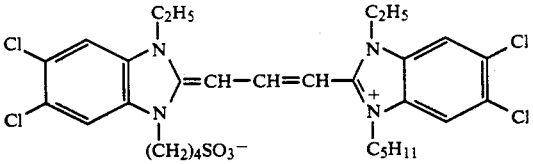
ExS-10
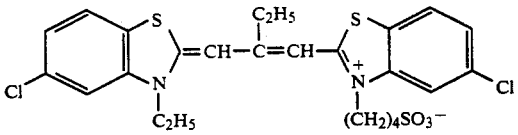
B-1
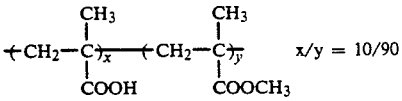
x/y = 10/90
B-2
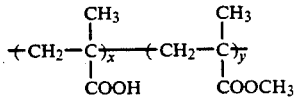
x/y = 40/60
B-3
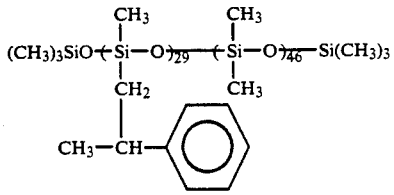
B-4
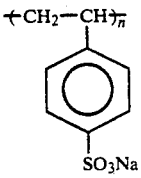
H-1
W-1

$CH_2{=}CH{-}SO_2{-}CH_2{-}CONH{-}CH_2$
$CH_2{=}CH{-}SO_2{-}CH_2{-}CONH{-}CH_2$

W-2

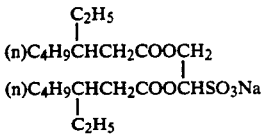

P-1
Copolymer of vinylpyrrolidone and vinyl alcohol (Copolymerization Degree = 70:30 (by weight))

F-1

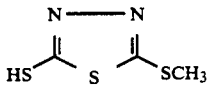

F-5

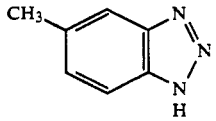

F-7

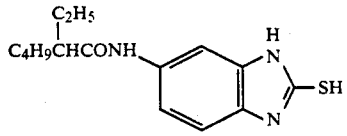

F-9

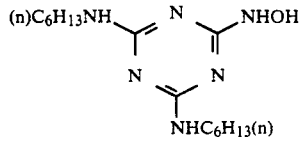

F-11

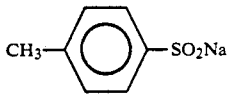

-continued

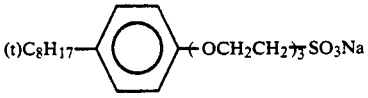

W-3
$C_8F_{17}SO_2N(C_3H_7)CH_2COOK$

P-2
Polyethyl acrylate

F-4

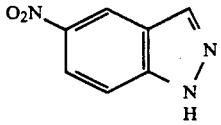

F-6

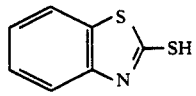

F-8

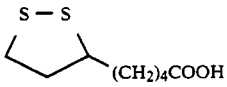

F-10

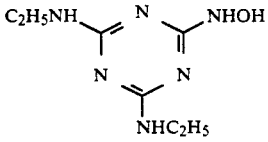

TABLE B

| Sample No. | Sensitizing Dye | Addition Amount (mole/mole Ag) |
|---|---|---|
| 201 (Comp.) | ExS-10 | $4.1 \times 10^{-4}$ |
| 202 (Comp.) | I-1 | $4.1 \times 10^{-4}$ |
| 203 (Comp.) | II-1 | $4.1 \times 10^{-4}$ |
| 204 (Comp.) | III-1 | $4.1 \times 10^{-4}$ |
| 205 (Inv.) | I-1 | $4.0 \times 10^{-4}$ |
| | II-1 | $1.0 \times 10^{-5}$ |
| 206 (Inv.) | I-1 | $4.0 \times 10^{-4}$ |
| | III-1 | $1.0 \times 10^{-5}$ |
| 207 (Inv.) | I-1 | $3.9 \times 10^{-4}$ |
| | II-1 | $1.0 \times 10^{-5}$ |
| | III-1 | $1.0 \times 10^{-5}$ |
| 208 (Inv.) | I-4 | $3.9 \times 10^{-4}$ |
| | II-4 | $1.0 \times 10^{-5}$ |
| | III-4 | $1.0 \times 10^{-5}$ |
| 209 (Inv.) | I-7 | $3.9 \times 10^{-4}$ |
| | II-7 | $1.0 \times 10^{-5}$ |
| | III-7 | $1.0 \times 10^{-5}$ |

Samples 201 to 210 were exposed at 1/100 second and 50 CMS via a white wedge and were subjected to sensitometry after processing as follows.

Further, the degree of residual color was evaluated from the difference between the magenta stain density of the sample and that of the sample of the dye blank.

The results showed that in a manner similar to Example 1, the present invention provided a sensitivity compatible with a residual color.

| | Processing Method | | | |
|---|---|---|---|---|
| Step | Time | Temperature (°C.) | Replenishing Amount (ml) | Tank Capacity (l) |
| Color Developing | 3 min. 15 sec. | 37.8 | 25 | 10 |
| Bleaching | 45 sec. | 38 | 5 | 4 |
| Bleach-Fixing (1) | 45 sec. | 38 | — | 4 |
| Bleach-Fixing (2) | 45 sec. | 38 | 30 | 4 |

-continued

| Processing Method | | | | |
|---|---|---|---|---|
| Step | Time | Temperature (°C.) | Replenishing Amount (ml) | Tank Capacity (l) |
| Washing (1) | 20 sec. | 38 | — | 2 |
| Washing (2) | 20 sec. | 38 | 30 | 2 |
| Stabilizing | 20 sec. | 38 | 20 | 2 |
| Drying | 1 min. | 55 | | |

The replenishing amount was per meter of 35 mm width.

The steps of bleach-fixing and washing were carried out using countercurrent system from (2) to (1), and all of the overflow bleaching solution was introduced into the bleach-fixing solution (2).

The amount of bleach-fixing solution carried over into the washing bath in the above processing was 2 ml per meter of a light-sensitive material with 35 mm width.

The compositions of the processing solutions used are shown below.

| | A | B |
|---|---|---|
| Color Developing Solution | | |
| Diethylenetriaminepentacetic acid | 5.0 g | 6.0 g |
| Sodium sulfite | 4.0 g | 5.0 g |
| Potassium carbonate | 30.0 g | 37.0 g |
| Potassium bromide | 1.3 g | 0.5 g |
| Potassium iodide | 1.2 mg | — |
| Hydroxylamine sulfate | 2.0 g | 3.6 g |
| 4-(N-ethyl-N-β-hydroxyethylamino)-2-methylaniline sulfate | 4.7 g | 6.2 g |
| Water to make | 1.0 l | 1.0 l |
| pH | 10.00 | 10.15 |
| Bleaching Solution | | |
| Ammonium 1,3-diaminopropanetetracetato ferrate monohydrate | 144.0 g | 206.0 g |
| 1,3-Diaminopropanetetracetic acid | 2.8 g | 4.0 g |
| Ammonium bromide | 84.0 g | 120.0 g |
| Ammonium nitrate | 17.5 g | 25.0 g |
| Ammonia (27% aq. soln.) | 10.0 g | 1.8 g |
| Acetic acid (98% aq. soln.) | 51.1 g | 73.0 g |
| Water to make | 1.0 l | 1.0 l |
| pH | 4.3 | 3.4 |
| Bleach-Fixing Solution | | |
| Ammonium ethylenediaminetetracetato ferrate dihydrate | 50.0 g | — |
| Disodium ethylenediaminetetracetate | 5.0 g | 25.0 g |
| Ammonium sulfite | 12.0 g | 20.0 g |
| Ammonium thiosulfate (aqueous solution (700 g/liter)) | 290.0 ml | 320.0 ml |
| Ammonia (27% aq. soln.) | 6.0 ml | 15.0 ml |
| Water to make | 1.0 l | 1.0 l |
| pH | 6.8 | 8.0 |

Note:
A: mother solution
B: replenishing solution

Washing Water (common to both the mother solution and replenishing solution)

City water was introduced into a mixed bed type column filled with an H type strong acidic cation exchange resin (Amberlite IR-120B) and an OH type strong base anion exchange resin (Amberlite IRA-400 each manufactured by Rohm & Haas Co., Ltd. to reduce the calcium and magnesium ion concentrations to 3 mg/liter or less, respectively, and subsequently sodium dichloroisocyanurate 20 mg/liter and sodium sulfate 150 mg/liter were added. The pH of this solution was 6.5 to 7.5.

| Stabilizing Solution (common to both the mother solution and replenishing solution) | |
|---|---|
| Formaldehyde (37% aq. soln.) | 1.2 ml |
| Surface active agent $C_{10}H_{21}$—O—$(CH_2CH_2O)_{10}$—H | 0.4 g |
| Ethylene glycol | 1.0 g |
| Water to make | 1.0 l |
| pH | 5.0 to 7.0 |

EXAMPLE 3

Preparation of Sample 301

The following first layer to twelfth layer were simultaneously coated on a paper support which had been laminated on both sides thereof with polyethylene, whereby a color photographic light-sensitive material was prepared. The polyethylene on the side on which the first layer was coated contained 15% by weight of an anatase type titanium oxide as a white pigment and small amount of ultramarine as a bluish dye.

Composition of Light-Sensitive Layer

The components and coated amounts in terms of g/m² are shown below. Silver halide is shown in terms of a coated amount converted to silver.

| | |
|---|---|
| First Layer (gelatin layer) | |
| Gelatin | 1.30 |
| Second Layer (anti-halation layer) | |
| Black colloidal silver | 0.10 |
| Gelatin | 0.70 |
| Third Layer (low sensitivity red-sensitive emulsion layer) | |
| Silver bromochloroiodide spectrally sensitized with a red sensitizing dye (ExS-3) (silver chloride: 1 mol %, silver iodide: 4 mol %, average grain size: 0.3 μm, grain size distribution: 10%, cube, core iodide type core/shell) | 0.06 |
| Silver bromoiodide spectrally sensitized with a red sensitizing dye (ExS-3) (silver iodide: 4 mol %, average grain size: 0.5 μm, grain size distribution: 15%, cube) | 0.10 |
| Gelatin | 1.00 |
| Cyan coupler (ExC-1) | 0.14 |
| Cyan coupler (ExC-2) | 0.07 |
| Anti-fading agent (Cpd-2, 3 and 4, equivalent) | 0.12 |
| Coupler dispersant (Cpd-6) | 0.03 |
| Coupler solvent (Solv-1, 2 and 3, equivalent) | 0.06 |
| Development accelerator (Cpd-13) | 0.05 |
| Fourth Layer (high sensitivity red-sensitive emulsion layer) | |
| Silver bromoiodide spectrally sensitized with a red sensitizing dye (ExS-3) (silver iodide: 6 mol %, average grain size: 0.8 μm, grain size distribution: 20%, tabular grains with an aspect ratio of 8, and iodide in a core) | 0.15 |
| Gelatin | 1.00 |
| Cyan coupler (ExC-1) | 0.20 |
| Cyan coupler (ExC-2) | 0.10 |
| Anti-fading agent (Cpd-2, 3 and 4, equivalent) | 0.15 |
| Coupler dispersant (Cpd-6) | 0.03 |
| Coupler solvent (Solv-1, 2 and 3, equivalent) | 0.10 |
| Fifth Layer (intermediate layer) | |
| Magenta colloidal silver | 0.02 |
| Gelatin | 1.00 |
| Anti-fading agent (Cpd-7 and 16) | 0.08 |
| Anti-fading agent solvent (Solv-4 and 5) | 0.16 |
| Polymer latex (Cpd-8) | 0.10 |
| Sixth Layer (low sensitivity green-sensitive emulsion layer) | |
| Silver bromochloroiodide spectrally sensitized with the green sensitizing dyes (ExS-1 and 2) (silver chloride: 1 mol %, silver iodide: 2.5 mol %, average grain size: 0.28 μm, grain size distribution: 8%, cube, core iodide type core/shell) | 0.04 |
| Silver bromoiodide spectrally sensitized with the green sensitizing dyes (ExS-1 and 2) (silver iodide: 2.5 mol %, average grain size: 0.48 μm, grain size distribution: | 0.06 |

-continued

| | |
|---|---|
| 12%, cube) | |
| Gelatin | 0.80 |
| Magenta coupler (ExM-1 and 2, equivalent) | 0.10 |
| Anti-fading agent (Cpd-9) | 0.10 |
| Anti-stain agent (Cpd-10 and 11, equivalent) | 0.01 |
| Anti-stain agent (Cpd-5) | 0.001 |
| Anti-stain agent (Cpd-12) | 0.01 |
| Coupler dispersant (Cpd-6) | 0.05 |
| Coupler solvent (Solv-4 and 6) | 0.15 |
| Seventh Layer (high sensitivity green-sensitive emulsion layer) | |
| Silver bromoiodide spectrally sensitized with the green sensitizing dyes (ExS-1 and 2) (silver iodide: 3.5 mol %, average grain size: 1.0 μm, grain size distribu- 21%, tabular grains with an aspect ratio tion: of 9, and even iodide type) | 0.10 |
| Gelatin | 0.80 |
| Magenta coupler (ExM-1 and 2, equivalent) | 0.10 |
| Anti-fading agent (Cpd-9) | 0.10 |
| Anti-stain agent (Cpd-10, 11 and 22, equivalent) | 0.01 |
| Anti-stain agent (Cpd-5) | 0.001 |
| Anti-stain agent (Cpd-12) | 0.01 |
| Coupler dispersant (Cpd-6) | 0.05 |
| Coupler solvent (Solv-4 and 6) | 0.15 |
| Eighth Layer (yellow filter layer) | |
| Yellow colloidal layer | 0.20 |
| Gelatin | 1.00 |
| Anti-fading agent (Cpd-7) | 0.06 |
| Anti-fading agent solvent (Solv-4 and 5) | 0.15 |
| Polymer latex (Cpd-8) | 0.10 |
| Ninth Layer (low sensitivity blue-sensitive emulsion layer) | |
| Silver bromochloroiodide spectrally sensitized with the blue sensitizing dyes (ExS-4 and 5) (silver chloride: 2 mol %, silver iodide: 2.5 mol %, average grain size: 0.38 μm, grain size distribution: 8%, cube, core iodide type core/shell) | 0.07 |
| Silver bromoiodide spectrally sensitized with the blue sensitizing dyes (ExS-4 and 5) (silver iodide: 2.5 mol %, average grain size: 0.55 μm, grain size distribution: 11%, cube | 0.10 |
| Gelatin | 0.50 |

-continued

| | |
|---|---|
| Yellow coupler (ExY-1 and 2, equivalent) | 0.20 |
| Anti-stain agent (Cpd-5) | 0.001 |
| Anti-fading agent (Cpd-14) | 0.10 |
| Coupler dispersant (Cpd-6) | 0.05 |
| Coupler solvent (Solv-2) | 0.05 |
| Tenth Layer (high sensitivity blue-sensitive emulsion layer) | |
| Silver bromoiodide spectrally sensitized with the blue sensitizing dyes (ExS-4 and 5) (silver iodide: 2.5 mol %, average grain size: 1.4 μm, grain size distribution: 21%, tabular grains with an aspect ratio of 14) | 0.25 |
| Gelatin | 1.00 |
| Yellow coupler (ExY-1 and 2, equivalent) | 0.40 |
| Anti-stain agent (Cpd-5) | 0.002 |
| Anti-fading agent (Cpd-14) | 0.10 |
| Coupler dispersant (Cpd-6) | 0.15 |
| Coupler solvent (Solv-2) | 0.10 |
| Eleventh Layer (UV absorbing layer) | |
| Gelatin | 1.50 |
| UV absorber (Cpd-1, 2, 4 and 15, equivalent) | 1.00 |
| Anti-fading agent (Cpd-7 and 16) | 0.06 |
| Coupler dispersant (Cpd-6) | 0.05 |
| UV absorber solvent (Solv-1 and 2) | 0.15 |
| Anti-irradiation dye (Cpd-17 and 18) | 0.02 |
| Anti-irradiation dye (Cpd-19 and 20) | 0.02 |
| Twelfth Layer (protective layer) | |
| Silver bromochloride fine grain (silver chloride: 97 mol %, average grain size: 0.2 μm) | 0.07 |
| Modified Poval | 0.02 |
| Gelatin | 1.50 |
| Gelatin hardener (H-1 and 2, equivalent) | 0.17 |

Further, Alkanol XC (manufactured by Du Pont Co., Ltd.) and sodium alkylbenzenesulfonate as an emulsifying dispersion aid and succinic acid ester and Magefac F-120 (manufactured by Dainippon Ink Chemical Ind. Co., Ltd.) as a coating aid were used for each of the layers. Cpd-21, 22 and 23 were used as a stabilizer for a silver halide or colloidal silver-containing layer. The compounds used in the examples are shown below:

ExS-1

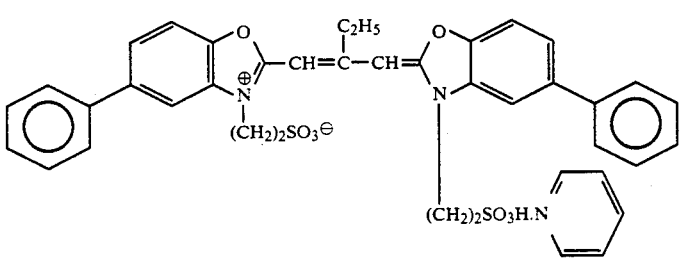

ExS-2

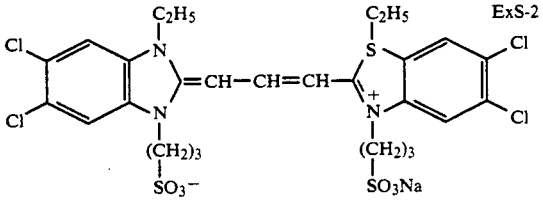

ExS-3

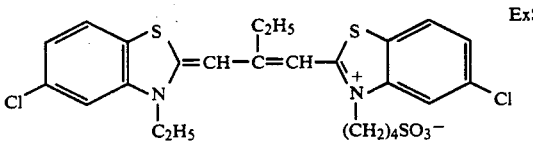

ExS-4

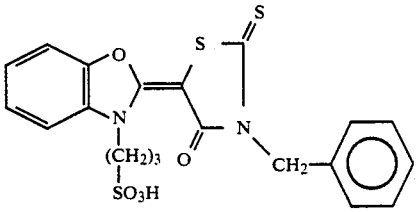

ExS-5

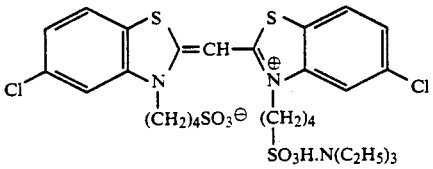

-continued
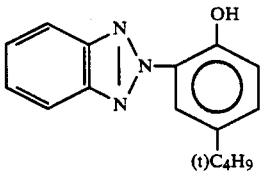
Cpd-1
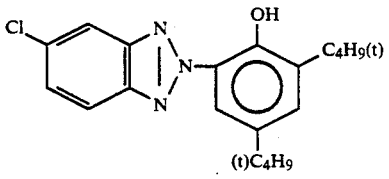
Cpd-2
Di(3-methylhexyl)phthalate Solv-3 Tricresyl phosphate Solv-4
Dibutyl phthalate Solv-5 Trioctyl phosphate Solv-6
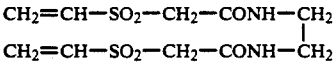
H-1 Sodium 4,6-dichloro-2-hydroxy-1,3,5-triazine H-2
ExY-1
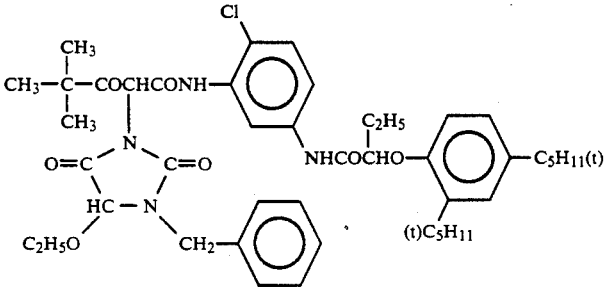
ExY-2
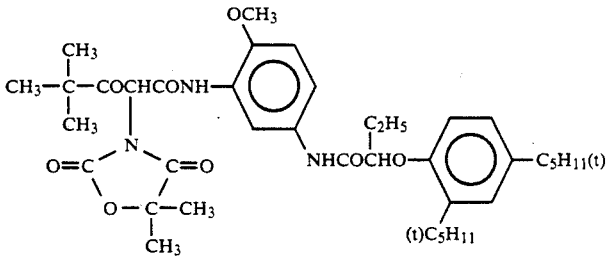
Di(2-ethylhexyl)phthalate Solv-1 Trinonyl phosphate Solv-2
ExC-2
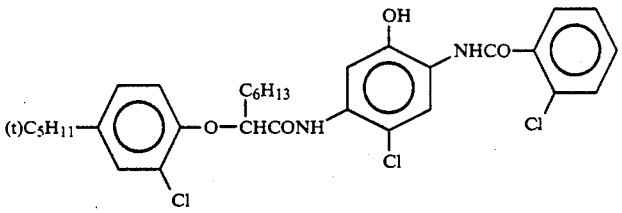
ExM-1
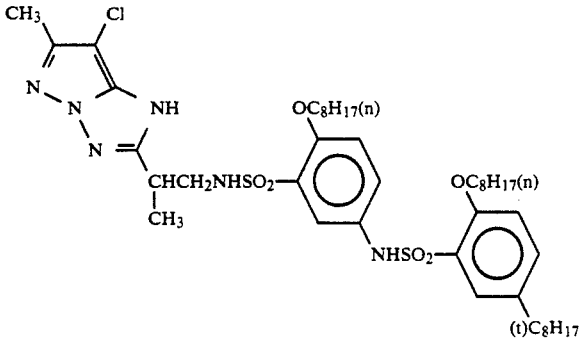

-continued
ExM-2
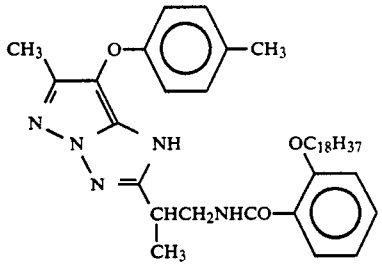
Cpd-21
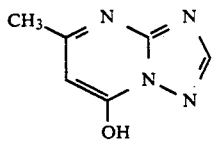
Cpd-22
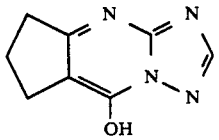
Cpd-23
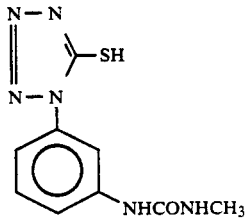
ExC-1
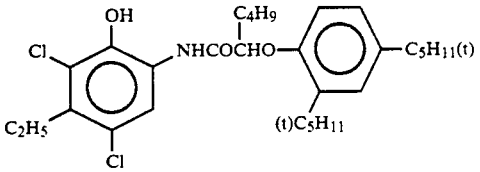
Cpd-17
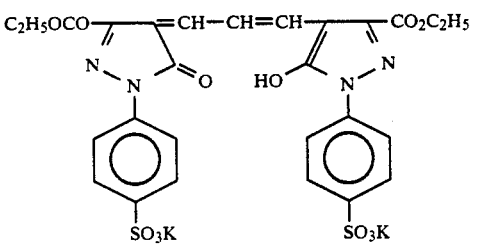
Cpd-18
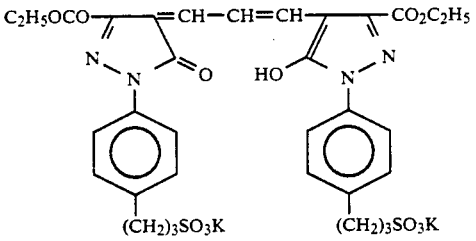
Cpd-19
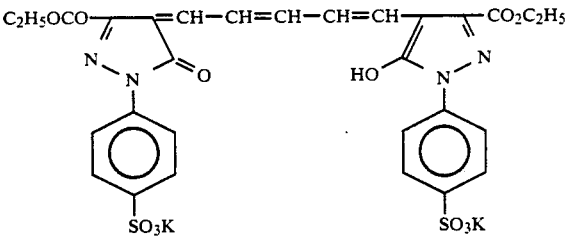
Cpd-20
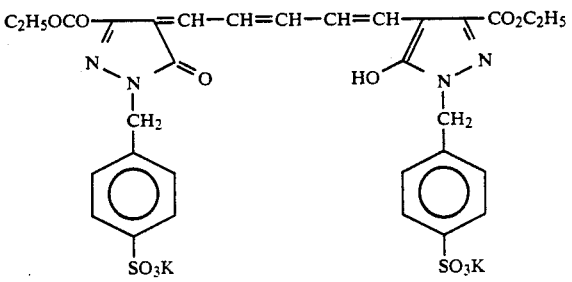

-continued
Cpd-12
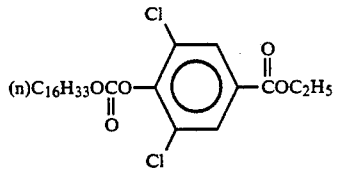
Cpd-14
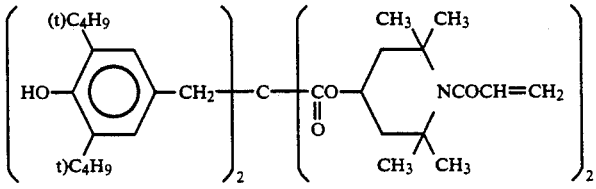
Cpd-15
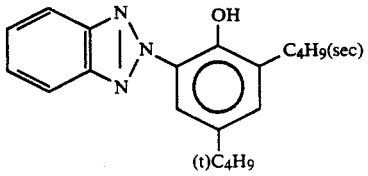
Cpd-16
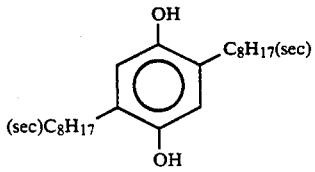
Polyethylacrylate(MW = 10,000~100,000)
Cpd-8
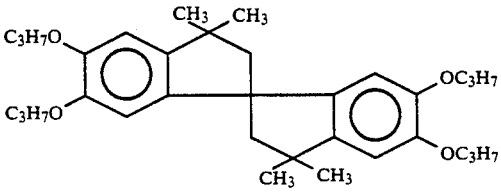
Cpd-9
Cpd-10
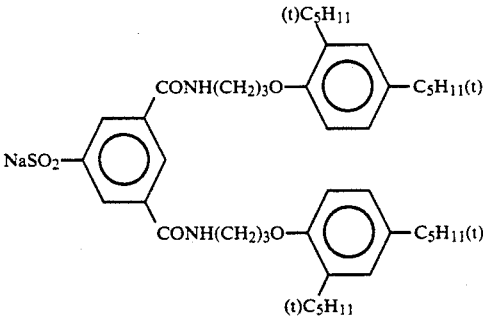
Cpd-11
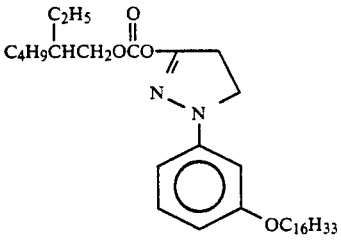
Cpd-3
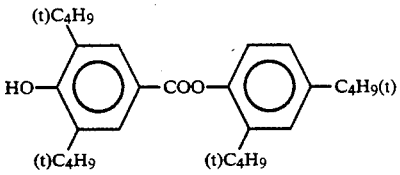
Cpd-4
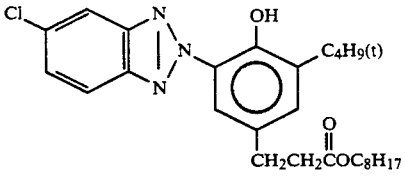
Cpd-5
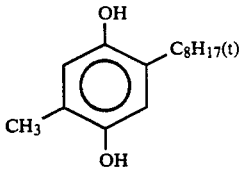
Cpd-6
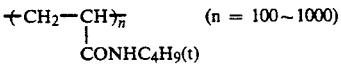
Cpd-7
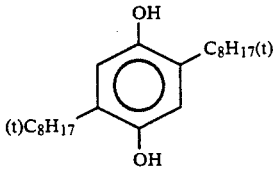

The sample was prepared in the same manner as Sample 301 except that sensitizing dye ExS-3 was replaced with the combination of the same sensitizing dyes as in Example 2 and was subjected to a white light wedge exposure. Then, it was subjected to the following processings and the same evaluation as in Examples 1 and 2.

The results showed that the same effects as in Examples 1 and 2 were obtained.

| Processing Steps: | | |
|---|---|---|
| Step | Temperature | Time |
| First Developing (black-and-white) | 38° C. | 75 seconds |
| Washing | 38° C. | 90 seconds |
| Reversal Exposure | 100 lux or more | 60 seconds or more |
| Color Developing | 38° C. | 135 seconds |
| Washing | 38° C. | 45 seconds |
| Bleach-Fixing | 38° C. | 120 seconds |
| Washing | 38° C. | 135 seconds |
| Drying | | |

| Compositions of Processing Solutions: | |
|---|---|
| First Developing Solution | |
| Pentasodium nitrilo-N,N,N-trimethylenephosphonate | 0.6 g |
| Pentasodium diethylenetriamine pentacetate | 4.0 g |
| Potassium sulfite | 30.0 g |
| Potassium thiocyanate | 1.2 g |
| Potassium carbonate | 35.0 g |
| Hydroquinone.potassium monosulfonate | 25.0 g |
| Diethylene glycol | 15.0 ml |
| 1-Phenyl-4-hydroxymethyl-4-methyl-3-pyrazolidone | 2.0 g |
| Potassium bromide | 0.5 g |
| Potassium iodide | 5.0 mg |
| Water to make | 1 l |
| | (pH 9.70) |
| Color Developing Solution | |
| Benzyl alcohol | 15.0 ml |
| Diethylene glycol | 12.0 ml |
| 3,6-Dithia-1,8-octanediol | 0.2 g |
| Pentasodium nitrilo-N,N,N-trimethylenephosphonate | 0.5 g |
| Pentasodium diethylenetriaminepentacetate | 2.0 g |
| Sodium sulfite | 2.0 g |
| Potassium carbonate | 25.0 g |
| Hydroxylamine sulfate | 3.0 g |
| N-ethyl-N-(β-methanesulfonamidoethyl)-3-methyl-4-aminoanline sulfate | 5.0 g |
| Potassium bromide | 0.5 g |
| Potassium iodide | 1.0 mg |
| Water to make | 1 l |
| | (pH 10.40) |
| Bleach-Fixing Solution | |
| 2-Mercapto-1,3,4-triazole | 1.0 g |
| Disodium ethylenediamineteracetate dihydrate | 5.0 g |
| Ammonium ethylenediaminetetracetato ferrate monohydrate | 80.0 g |
| Sodium sulfite | 15.0 g |
| Sodium thiosulfate (700 g/l solution) | 160.0 ml |
| Glacial acetic acid | 5.0 ml |
| Water to make | 1 l |
| | (pH 6.50) |

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support having thereon at least one silver halide emulsion layer containing (A) at least oneof the methine compounds represented by the following Formula (I):

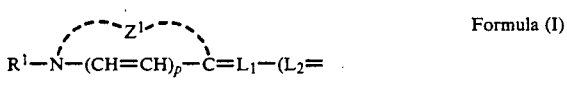

Formula (I)

-continued

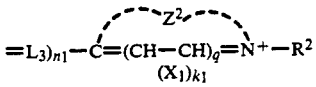

wherein $R^1$ represents $-(CH_2)_r-CONHSO_2-R^3$, $-(CH_2)_s-SO_2NHCO-R^4$, $-(CH_2)_t-CONHCO-R^5$, or $-(CH_2)_u-SO_2NHSO_2-R^6$, in which $R^3$, $R^4$, $R^5$ and $R^6$ each represents an alkyl group, an alkoxy group or an amino group and r, s, t and u each represents an integer of 1 to 5; $R^2$ represents an alkyl group which is different from $R^1$; $Z^1$ and $Z^2$ may be the same or different and represent a group of non-metallic atoms necessary to form a 5- or 6-membered heterocyclic ring; $L_1$; $L_2$ and $L_3$ each represents a methine group; $n_1$ represents 0, 1 or 2;; $X_1$ represents an anion; $k_1$ represents a number necessary to adjust the charge of the molecule to 0; and p and q each represents 0 or 1; and (B) at least one of the methine compounds represented by the following Formula (II) or Formula (III):

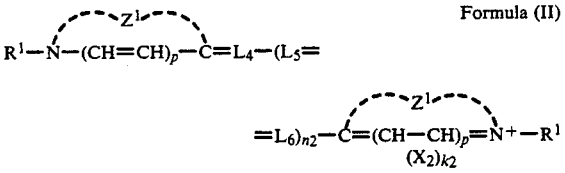

Formula (II)

wherein $Z^1$ represents the same non-metallic atoms as the non-metallic atoms of $Z^1$ in Formula (I); $R^1$ is the same substituent as $R^1$ in Formula (I); $L_4$, $L_5$ and $L_6$ have the same meaning as $L_1$, $L_2$ and $L_3$; $X_2$ has the same meaning as $X_1$; $n_2$ has the same meaning as $n_1$; and p has the same meaning as p in Formula (I);

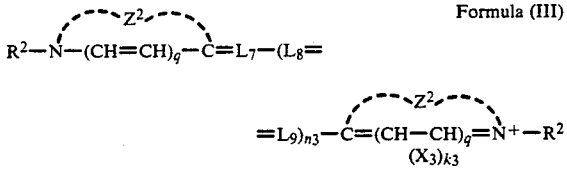

Formula (III)

wherein $Z^2$ represents the same non-metallic atoms as the non-metallic atoms of $Z^2$ in Formula (I); $R^2$ is the same substituent as $R^2$ in Formula (I); $L_7$, $L_8$ and $L_9$ have the same meaning as $L_1$, $L_2$ and $L_3$; $X_3$ has the same meaning as $X_1$; $n_3$ has the same meaning as $n_1$; and q has the same meaning as q in Formula (I).

2. The light-sensitive material of claim 1, wherein the 5- or 6-membered heterocyclic nucleus formed by $Z^1$ and $Z^2$ is a thiazole nucleus, a benzothiazole nucleus, a naphthothiazole nucleus, a thiazoline nuoleus, an oxazole nucleus, a benzoxazole nucleus, a naphthoxazole nucleus, an oxazoline nucleus, a selenazole nucleus, a benzoselenazole nucleus, a naphthoselenazole nucleus, a selenazoline nucleus, a tellurazole nucleus, a benzotellurazole nucleus, a naphthotellurazole nucleus, a tellurazoline nucleus, a 3,3-dialkylindolenine nucleus, an imidazole nucleus, a benzimidazole nucleus, a naphthoimidazole nucleus, a pyridine nucleus, a quinoline nucleus, an isoquinoline nucleus, an imidazo[4,5 b]-quinoxaline nucleus, an oxadiazole nucleus, a thiadiazole nucleus, a tetrazole nucleus or a pyrimidine nucleus.

3. The light sensitive material of claim 1, wherein the alkyl group represented by $R^3$, $R^4$, $R^5$ and $R^6$ is unsubstituted or substituted and has 1 to 4 carbon atoms; and the alkyl group represented by $R^2$ is an alkyl group with 1 to 5 carbon atoms.

4. The light-sensitive material of claim 1, wherein the 5 or 6-membered heterocyclic ring, represented by $Z^1$ and $Z^2$ in the methine compound represented by Formula (I), Formula (II) or Formula (III) is a benzothiazole ring or a benzoselenazole ring.

5. The light-sensitive material of claim 1, wherein the methine group represented by $L_1$, $L_2$ and $L_3$ is unsubstituted or substituted with one or more of an alkyl group, a halogen atom, an alkoxy group or an alkylthio group; and wherein $L_1$, $L_2$ and $L_3$ can combine and form a ring or an auxochrome.

* * * * *